US008129085B2

(12) United States Patent
Yamamoto et al.

(10) Patent No.: US 8,129,085 B2
(45) Date of Patent: Mar. 6, 2012

(54) TONER, METHOD OF MANUFACTURING THE SAME, TWO-COMPONENT DEVELOPER, DEVELOPING DEVICE, AND IMAGE FORMING APPARATUS

(75) Inventors: Yoshinori Yamamoto, Niimi (JP); Hiroshi Onda, Yamatokoriyama (JP); Yoshiaki Akazawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 849 days.

(21) Appl. No.: 12/178,130

(22) Filed: Jul. 23, 2008

(65) Prior Publication Data

US 2009/0029280 A1 Jan. 29, 2009

(30) Foreign Application Priority Data

Jul. 23, 2007 (JP) ..... P2007-191336

(51) Int. Cl.
*G03G 5/00* (2006.01)
*G03G 9/08* (2006.01)

(52) U.S. Cl. ..... 430/137.2; 430/110.3; 430/110.4

(58) Field of Classification Search ..... 430/110.4, 430/137.2

See application file for complete search history.

(56) References Cited

U.S. PATENT DOCUMENTS

| | | | | |
|---|---|---|---|---|
| 5,137,796 | A | 8/1992 | Takiguchi et al. | |
| 5,262,267 | A | 11/1993 | Takiguchi et al. | |
| 5,437,949 | A | 8/1995 | Kanbayashi et al. | |
| 5,512,406 | A * | 4/1996 | Takeda et al. | 430/110.4 |
| 5,547,797 | A | 8/1996 | Anno et al. | |
| 7,769,311 | B2 * | 8/2010 | Tsubaki | 399/67 |
| 2002/0160289 | A1 * | 10/2002 | Teshima et al. | 430/108.1 |
| 2006/0063090 | A1 * | 3/2006 | Eida | 430/110.4 |
| 2006/0084002 | A1 | 4/2006 | Shibai et al. | |
| 2006/0084003 | A1 | 4/2006 | Shibai et al. | |

FOREIGN PATENT DOCUMENTS

| | | | |
|---|---|---|---|
| JP | 2-284158 | A | 11/1990 |
| JP | 2-287366 | A | 11/1990 |
| JP | 7-49584 | | 2/1995 |
| JP | 7-146589 | A | 6/1995 |
| JP | 8-137134 | A | 5/1996 |
| JP | 11-194527 | A | 7/1999 |
| JP | 2001-249488 | A | 9/2001 |
| JP | 2002-351133 | A | 12/2002 |
| JP | 2004-13049 | A | 1/2004 |
| JP | 2004-302422 | | 10/2004 |
| JP | 2005-315962 | A | 11/2005 |
| JP | 2006-119211 | A | 5/2006 |
| JP | 2006-293335 | | 10/2006 |

* cited by examiner

*Primary Examiner* — Christopher Rodee
*Assistant Examiner* — Jonathan Jelsma
(74) *Attorney, Agent, or Firm* — Nixon & Vanderhye P.C.

(57) ABSTRACT

A toner includes toner particles containing at least binder resin and colorant. The toner particles contain a large-sized toner particle group of particles and a small-sized toner particle group of particles having a volume average particle size smaller than that of the large-sized toner particle group. In the toner, a volume average particle size $D_{50v}$ is 4 μm to 8 μm at 50% in accumulated volume counted from a large particle-side in accumulated volume distribution of entire toner particles; a content of toner particles contained in a toner particle group having a volume average particle size of 7 μm or more is 24% to 47% by volume based on the entire toner particles; and a content of toner particles contained in a toner particle group having a number average particle size of 5 μm or less is 10% to 50% by number or less based on the entire toner particles.

5 Claims, 4 Drawing Sheets

TONER, METHOD OF MANUFACTURING THE SAME, TWO-COMPONENT DEVELOPER, DEVELOPING DEVICE, AND IMAGE FORMING APPARATUS

CROSS-REFERENCE TO RELATED APPLICATION

This application claims priority to Japanese Patent Application No. 2007-191336, which was filed on Jul. 23, 2007, the contents of which are incorporated herein by reference in its entirety.

BACKGROUND OF THE INVENTION

1. Field of the Invention

The present invention relates to a toner, a method of manufacturing the toner, a two-component developer, a developing device, and an image forming apparatus.

2. Description of the Related Art

Electrophotographic image forming apparatuses have been widely used as copiers so far, and in recent days, also as printers, facsimile machines, and the like equipment along with spread of computers since the electrophotographic image forming apparatus operates excellently as output units for computer images created by computers. In a general electrophotographic image forming apparatus, a desired image is formed on a recording medium through a charging step, an exposing step, a developing step, a transferring step, a fixing step, and a cleaning step. In the charging step, a photosensitive layer on a surface of a photoreceptor serving as an image bearing member is homogeneously charged. In the exposing step, the charged surface of the photoreceptor is irradiated with signal light corresponding to an original image so that an electrostatic latent image is formed. In the developing step, an electrophotographic toner (hereinafter referred to simply as "toner") is supplied to the electrostatic latent image on the surface of the photoreceptor so that the electrostatic latent image is formed into a visualized image. In the transferring step, the visualized image on the surface of the photoreceptor is transferred onto a recording medium such as paper or OHP sheet. In the fixing step, the visualized image is fixed onto the recording medium by heat, pressure, etc. In the cleaning step, a toner and other matters remaining on the surface of the photoreceptor from which the visualized image has been transferred, are removed by a cleaning blade, and the surface of the photoreceptor is thus cleaned. Note that the visualized image may be transferred onto the recording medium by way of an intermediate transfer medium.

In the meantime, various techniques for computers have been further developed. For example, definition of computer images becomes higher and higher. This raises a demand on the electrophotographic image forming apparatus to form high-definition images almost equivalent to the computer images by reproducing tiny shapes, slight hue variation, etc. of the computer images precisely and clearly. In response to the demand, the development of definition of the electrostatic latent images has been accelerated and accordingly, with the aim of accurately reproducing high resolution electrostatic latent images, various techniques have been proposed to enhance properties of the developer which is to be attached to the recording medium, for example, to enhance image resolution, image sharpness, etc. In especially a large number of techniques proposed as above, toner particles are reduced in diameter to thereby enhance image quality. There have been thus various studies on the manufacture of a toner having small particles. The toner having small particles is useful for formation of high resolution images, but disadvantageous in that the fluidity of the toner is low since a large amount of particles of the toner have a volume average particle size of 4 μm or less.

The toner particles having a great impact on the toner fluidity, the image resolution, and the image sharpness are 7 μm or more and 5 μm or less in volume average particle size. It is therefore necessary to control a content of the toner particles having a volume average particles size of 7 μm or more and 5 μm or less in order to form high-quality images having sufficiently high definition and high resolution with toners excellent in the fluidity.

The color toner disclosed in Japanese Unexamined Patent Publication JP-A 7-146589 (1995), for example, has particles having a weight average particle size of 3 μm to 7 μm. The particles contain 10% by number to 70% by number of color toner particles of 4.00 μm or less, 40% by number or more of color toner particles of 5.04 μm or less, 2% by volume to 20% by volume of color toner particles of 8.00 μm or more, and 6% by volume of color toner particles of 10.08 μm or more, Tinting strength of the color toner is such that image density ($D_{0.5}$) with the toner fixed is 1.0 to 1.8 when an amount (M/S) of unfixed color toner on a transfer member is 0.50 mg/cm$^2$.

Although the color toner of JP-A 7-146589 contains 40% by number or more of color toner particles of 5.04 μm or less and 2% by volume to 20% by volume of color toner particles of 8.00 μm or more, such contents are not enough to provide the toner with favorable fluidity, resulting in a failure to form high-quality images having sufficiently high definition and high resolution.

SUMMARY OF THE INVENTION

In view of the problem as above, the invention has been completed. An object of the invention is to provide a toner which is excellent in fluidity and capable of forming a high-quality image of high definition and high resolution, and to provide a method of manufacturing the toner, as well as a two-component developer, a developing device, and an image forming apparatus.

The invention provides a toner comprising toner particles containing at least binder resin and colorant, the toner particles including a large-sized toner particle group of particles and a small-sized toner particle group of particles having a volume average particle size smaller than that of the large-sized toner particle group of particles, wherein a volume average particle size $D_{50v}$ which is a particle size at 50% in accumulated volume counted from a large particle-side in accumulated volume distribution of entire toner particles is 4 μm or more and 8 μm or less, a content of toner particles contained in a toner particle group having a volume average particle size of 7 μm or more is 24% by volume or more and 47% by volume or less based on the entire toner particles, and a content of toner particles contained in a toner particle group having a number average particle size of 5 μm or less is 10% by number or more and 50% by number or less based on the entire toner particles.

According to the invention, the toner of the invention comprises toner particles containing at least binder resin and colorant, and the toner particles include a large-sized toner particle group of particles and a small-sized toner particle group of particles having a volume average particle size smaller than that of the large-sized toner particle group of particles. In the toner, a volume average particle size $D_{50v}$ at 50% in accumulated volume counted from a large particle-side is 4 μm or more and 8 μm or less in accumulated volume distribution of the entire toner particles while a content of toner particles contained in a toner particle group having a volume average particle size of 7 μm or more is 24% by volume or more and 47% by volume or less based on the entire toner particles, and a content of toner particles contained in a toner particle group having a number average particle size of 5 μm or less is 10% by number or more and 50% by number or less based on the entire toner particles.

The toner contains a large-sized toner particle group of particles and a small-sized toner particle group of particles, and in the toner comprising toner particles having a volume average particle size $D_{50v}$ of 4 μm or more and 8 μm or less. Since the contents of the toner particles contained in the toner particle group having a volume average particle size of 7 μm or more and the toner particles contained in the toner particle group having a number average particle size of 5 μm or less as above, to the entire toner particles, are controlled, the toner will be excellent in fluidity and capable of forming a high-quality image having high definition and high resolution.

Further, in the invention, it is preferable that an average degree of circularity of the entire toner particles is 0.955 or more and 0.975 or less.

According to the invention, an average degree of circularity of the entire toner particles is 0.955 or more and 0.975 or less. The toner particles thus have favorable shapes and are therefore capable of maintaining good cleaning properties and high-level transfer efficiency, allowing for stable formation of high-quality images.

Further, in the invention, it is preferable that at least one of the large-sized toner particle group of particles and the small-sized toner particle group of particles is treated with a spheronization process.

According to the invention, at least one of the large-sized toner particle group of particles and the small-sized toner particle group of particles is treated with a spheronization process. This enables the transfer efficiency to maintain at high level, allowing for stable formation of high-quality images.

The invention provides a method of manufacturing a toner, comprising:

a preliminarily mixing step of mixing at least binder resin and colorant into a mixture;

a melt-kneading step of melt-kneading the mixture into a melt-kneaded product;

a pulverizing step of pulverizing the melt-kneaded product into a pulverized product;

a classifying step of classifying the pulverized product into a large-sized toner particle group of particles and a small-sized toner particle group of particles having a volume average particle size smaller than that of the large-sized toner particle group of particles; and a mixing step of mixing the large-sized toner particle group of particles and the small-sized toner particle group of particles.

According to the invention, the toner is manufactured in a manner that: in a preliminary mixing step, at least binder resin and colorant are mixed into a mixture; in a melt-kneading step, the mixture is melt-kneaded into a melt-kneaded product; in a pulverizing step, the melt-kneaded product is pulverized into a pulverized product; in a classifying step, the pulverized product is classified into a large-sized toner particle group of particles and a small-sized toner particle group of particles having a volume average particle size smaller than that of the large-sized toner particle group of particles; and in a mixing step, the large-sized toner particle group of particles and the small-sized toner particle group of particles are mixed with each other.

The toner of the invention can be thus manufactured which is excellent in fluidity and capable of forming a high-quality image of high definition and high resolution.

Further, in the invention, it is preferable that a mixing ratio of the large-sized toner particle group of particles to the small-sized toner particle group of particles in the preliminarily mixing step is from 3.4:10 to 30:10.

According to the invention, the large-sized toner particle group of particles and the mall-sized particle group of particles are mixed in a ratio of from 3.4:10 to 30:10 in the preliminarily mixing step. In the toner, it is thus possible to more reliably set within favorable ranges the contents of the toner particles contained in the toner particle group having a volume average particle size of 7 μm or more and the toner particles contained in the toner particle group having a number average particle size of 5 μm or less based on the entire toner particles, thus allowing for more reliable manufacture of the toner of the invention which is excellent in fluidity and capable of forming a high-quality image of high definition and high resolution.

Further, in the invention, it is preferable that a spheronizing step of treating at least one of the large-sized toner particle group of particles and the small-sized toner particle group of particles with a spheronization process is interposed between the classifying step and the mixing step.

According to the invention, there is interposed between the classifying step and the mixing step a spheronizing step in which at least one of the large-sized toner particle group of particles and the small-sized toner particle group of particles is treated with a spheronization process. By so doing, the average degree of circularity and circularity distribution of the entire toner particles can be controlled, thus resulting in the toner particles having favorable shapes. Consequently, the toner thus manufactured is capable of maintaining the transfer efficiency at high level and stably forming high-quality images.

Further, in the invention, it is preferable that mechanical impact or hot air is used for the spheronization process in the spheronizing step.

According to the invention, mechanical impact or hot air is used for the spheronization process in the spheronizing step. By so doing, the average degree of circularity and circularity distribution of the entire toner particles can be controlled, thus resulting in the toner particles having favorable shapes. Consequently, the toner thus manufactured is capable of more easily maintaining the transfer efficiency at high level and stably forming high-quality images.

Further, in the invention, it is preferable that the large-sized toner particle group of particles has a volume average particle size of 6 μm or more and 9 μm or less.

According to the invention, the large-sized toner particle group of particles has a volume average particle size of 6 μm or more and 9 μm or less. This makes it easy to adjust the contents of the toner particles contained in the toner particle group having a volume average particle size of 7 μm or more and the toner particles contained in the toner particle group having a number average particle size of 5 μm or less based on the entire toner particles so that the contents each fall in a favorable range, thus allowing for easy manufacture of the toner of the invention which is excellent in fluidity and capable of forming a high-quality image of high definition and high resolution.

Further, in the invention, it is preferable that the small-sized toner particle group of particles has a volume average particle size of 3.5 μm or more and less than 6 μm.

According to the invention, the small-sized toner particle group of particles has a volume average particle size of 3.5 μm or more and less than 6 μm. This makes it easy to adjust the contents of the toner particles contained in the toner particle group having a volume average particle size of 7 μm or more and the toner particles contained in the toner particle group having a number average particle size of 5 μm or less based on the entire toner particles so that the contents each fall in a favorable range, thus allowing for easy manufacture of the toner of the invention which is excellent in fluidity and capable of forming a high-quality image of high definition and high resolution.

The invention provides a two-component developer containing the toner mentioned above and a carrier.

According to the invention, a two-component developer of the invention contains a carrier and the toner of the invention which is excellent in fluidity and capable of forming a high-quality image of high definition and high resolution, allowing for reduced variations of charge distribution, with the result that a good developing property can be maintained.

The invention provides a developing device performing development with use of a developer containing the toner.

According to the invention, a developer containing the above toner is used to perform development in a developing device, with the result that a toner image of high definition and high resolution can be formed on a photoreceptor.

The invention provides an image forming apparatus having the developing device mentioned above.

According to the invention, an image forming apparatus of the invention has the developing device and is thereby capable of forming a high-quality image of high definition and high resolution.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
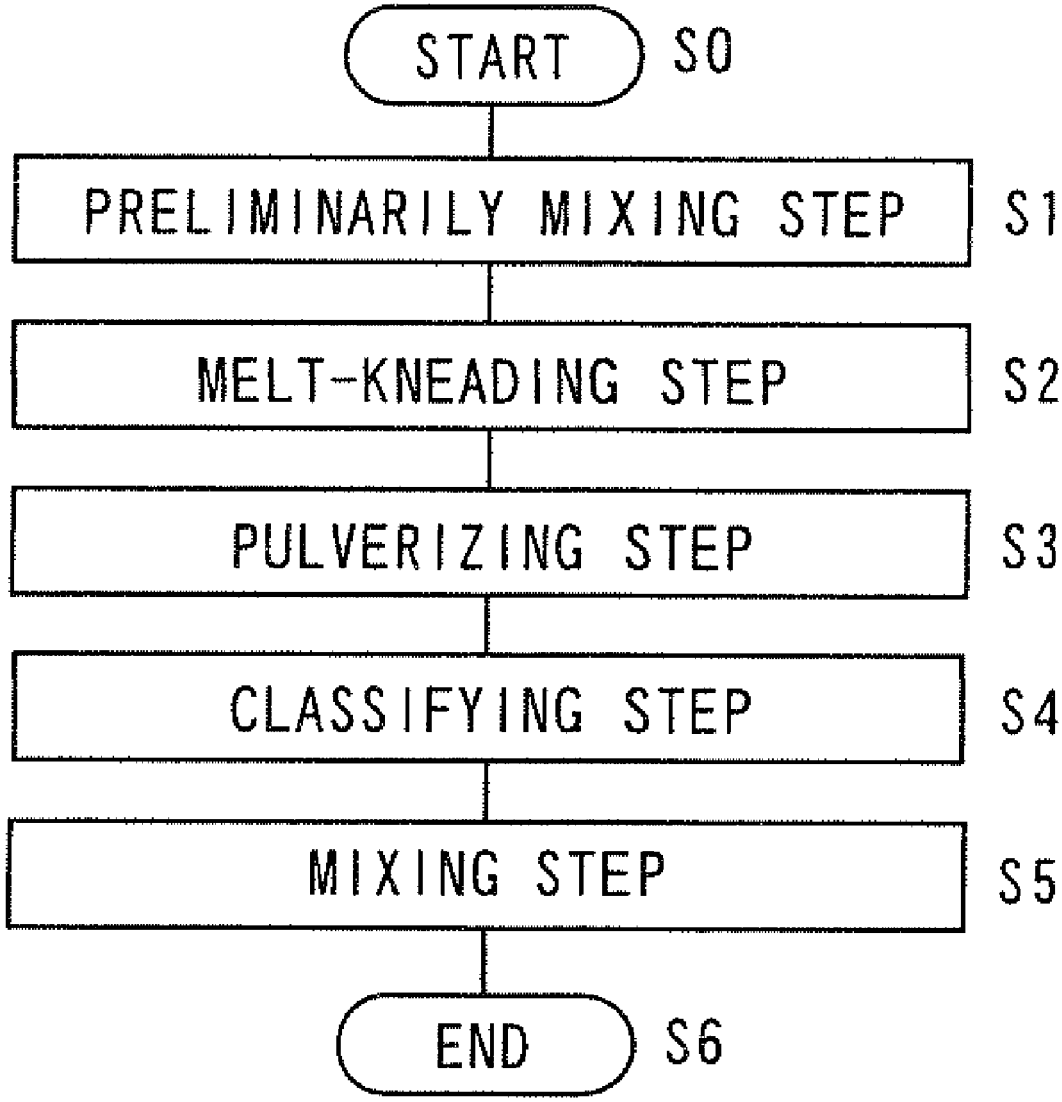
FIG. 1 is a flowchart showing one example of procedure in a method of manufacturing a toner of the invention.

Now referring to the drawings, preferred embodiments of the invention are described below.

A toner of the invention comprises toner particles containing at least binder resin and colorant, which toner particles include a large-sized toner particle group of particles and a small-sized toner particle group of particles having a volume average particle size smaller than that of the large-sized toner particle group of particles. In the toner, a volume average particle size $D_{50v}$ at 50% in accumulated volume counted from a large particle-side in accumulated volume distribution of the entire toner particles is 4 μm or more and 8 μm or less while a content of toner particles contained in a toner particle group having a volume average particle size of 7 μm or more is 24% by volume to 47% by volume based on the entire toner particles, and a content of toner particles contained in a toner particle group having a number average particle size of 5 μm or less is 10% by number to 50% by number based on the entire toner particles.

As above, the toner of the invention contains a large-sized toner particle group of particles and a small-sized toner particle group of particles. Since, based on the entire toner particles, the contents of the toner particles (hereinafter referred to as "coarse toner particles") contained in the toner particle group having a volume average particle size of 7 μm or more and the toner particles (hereinafter referred to as a "fine toner particles") contained in the toner particle group having a number average particle size of 5 μm or less in the toner particles having the volume average particle size $D_{50v}$ of 4 μm or more and 8 μm or less are controlled, the toner will be excellent in fluidity and capable of forming a high-quality image having high definition and high resolution.

In the case where a volume average particle size $D_{50v}$ of entire toner particles is less than 4 μm, the toner containing such toner particles have degraded fluidity and transfer efficiency which cause toner scattering, togging, or the like trouble and moreover lead to a decrease in the cleaning property. Worse still, it is difficult to manufacture the toner. The toner having a volume average particle size $D_{50v}$ more than 8 μm has particles too large to form an image of high definition.

The toner containing the coarse toner particles less than 24% by volume based on the entire toner particles has such low fluidity as to cause toner scattering and such low transfer efficiency as to cause fogging. Worse still, there arise problems such as a cleaning failure of a photoreceptor, resulting in an adverse effect on an image to be formed. The toner containing the coarse toner particles more than 47% by volume based on the entire toner particles leads to low resolution and thus fails to form a high-quality image of sufficiently high definition and resolution.

The toner containing the fine toner particles less than 10% by number based on the entire toner particles leads to low resolution and thus fails to form a high-quality image of sufficiently high definition and resolution. The toner containing the fine toner particles more than 50% by number based on the entire toner particles has such low fluidity as to cause toner scattering and such low transfer efficiency as to cause fogging. Worse still, there arise problems such as a cleaning failure of a photoreceptor, resulting in an adverse effect on an image to be formed.

In the toner of the invention, an average degree of circularity of entire toner particles is preferably 0.955 or more and 0.975 or less. When the average degree of circularity of entire toner particles is within the above range, the toner particles are formed into favorable shapes and therefore capable of maintaining good cleaning properties and high-level transfer efficiency, allowing for stable formation of high-quality images.

When the average degree of circularity of the entire toner particles is less than 0.955, the content of irregularly-shaped toner particles (hereinafter referred to as "irregularly-shaped toner particles") is high based on the entire toner particles, leading to lower transfer efficiency which may result in a failure to stably from high-quality images. When the average degree of circularity of the entire toner particles is more than 0.975, the content of toner particles shaped into almost perfect spheres is high, which makes it difficult for a cleaning blade to catch the toner particles, thus leading to a lower cleaning property and possibly causing difficulty in removing the toner particles remaining on a surface of a photoreceptor from which a toner image has been transferred to a recording medium.

The volume average particle size ($D_{50v}$) and content (% by volume, % by number) herein are measured by a particle size distribution-measuring device: MULTISIZER III (trade name) manufactured by Beckman Coulter, Inc. Measurement conditions are as follows.

Aperture diameter: 20 μm

Number of measured particles: 50,000 counts

Analysis software: COULTER MULTISIZER ACCUCOMP 1.19 version (manufactured by Beckman Coulter, Inc.)

Electrolyte: ISOTON II (manufactured by Beckman Coulter, Inc.)

Dispersant: sodium alkylether sulfate

Measuring method: In a beaker, 50 ml of the electrolyte, 20 mg of the sample, and 1 ml of the dispersant are put and then treated with a three-minute dispersion process in an ultrasonic disperser, thereby preparing a measurement sample of which particle size is measured by the above device MULTISIZER III. From a measurement result thus obtained, volume particle size distribution and number particle size distribution of the sample particles are determined. From the volume particle size distribution, the volume average particle size ($D_{50v}$) and the content (% by volume) of the coarse toner particles based on the entire toner particles are determined. From the number particle size distribution, the content (% by number) of the fine toner particles based on the entire toner particles is determined.

Further, the degree of circularity (ai) of the toner particle is defined by the following expression (1). The degree of circularity (ai) as defined by the expression (1) is determined by using a flow particle image analyzer: FPIA-3000 manufactured by Sysmex Corporation. Moreover, a sum of respective degrees of circularity (ai) of "m" pieces of toner particles is divided by the number "m" of the toner particles as in the following expression (2) to obtain an arithmetic mean value which is defined as an average degree of circularity (a).

$$\text{Degree of circularity}(ai)=(\text{Peripheral length of circle having the same projection area as that of particle image})/(\text{Length of circumference of projection image of particles}) \quad (1)$$

$$\text{Average degree of circularity}(a)=\sum_{i=1}^{m} ai/m \quad (2)$$

In the above analyzer FPIA-3000, a simple calculation method is used that the degrees of circularity (ai) of the respective toner particles are determined; thus-obtained degrees 0.40 to 1.00 in circularity (ai) of the respective toner particles are divided into 61 divisions for every 0.01; frequencies for the respective divisions are obtained; and medians and the frequencies for respective divisions are used to determine the average degree of circularity. Since a value of the average degree of circularity thus obtained by the simple calculation method is not so different from a value of the average degree of circularity (a) obtained by the above expression (2) that a difference therebetween can be substantially overlooked, the average degree of circularity obtained by the simple calculation method is regarded as the average degree of circularity (a) defined by the expression (2) in the present embodiment.

A specific method of measuring the average degree of circularity (ai) is as follows. In 10 ml of water having about 0.1 mg of surfactant dissolved therein, 5 mg of the toner is dispersed. Dispersion is thus prepared. The dispersion is then irradiated for five minutes with ultrasonic wave which is 20 kHz in frequency and 50 W in outputs, to thereby adjust concentration of toner particles in the dispersion to 5,000 pieces/μL to 20,000 pieces/μL. On the basis of the dispersion, the degrees of circularity (ai) are then measured to determine the average degree of circularity (a) by the above analyzer FPIA-3000.

Figure 2:
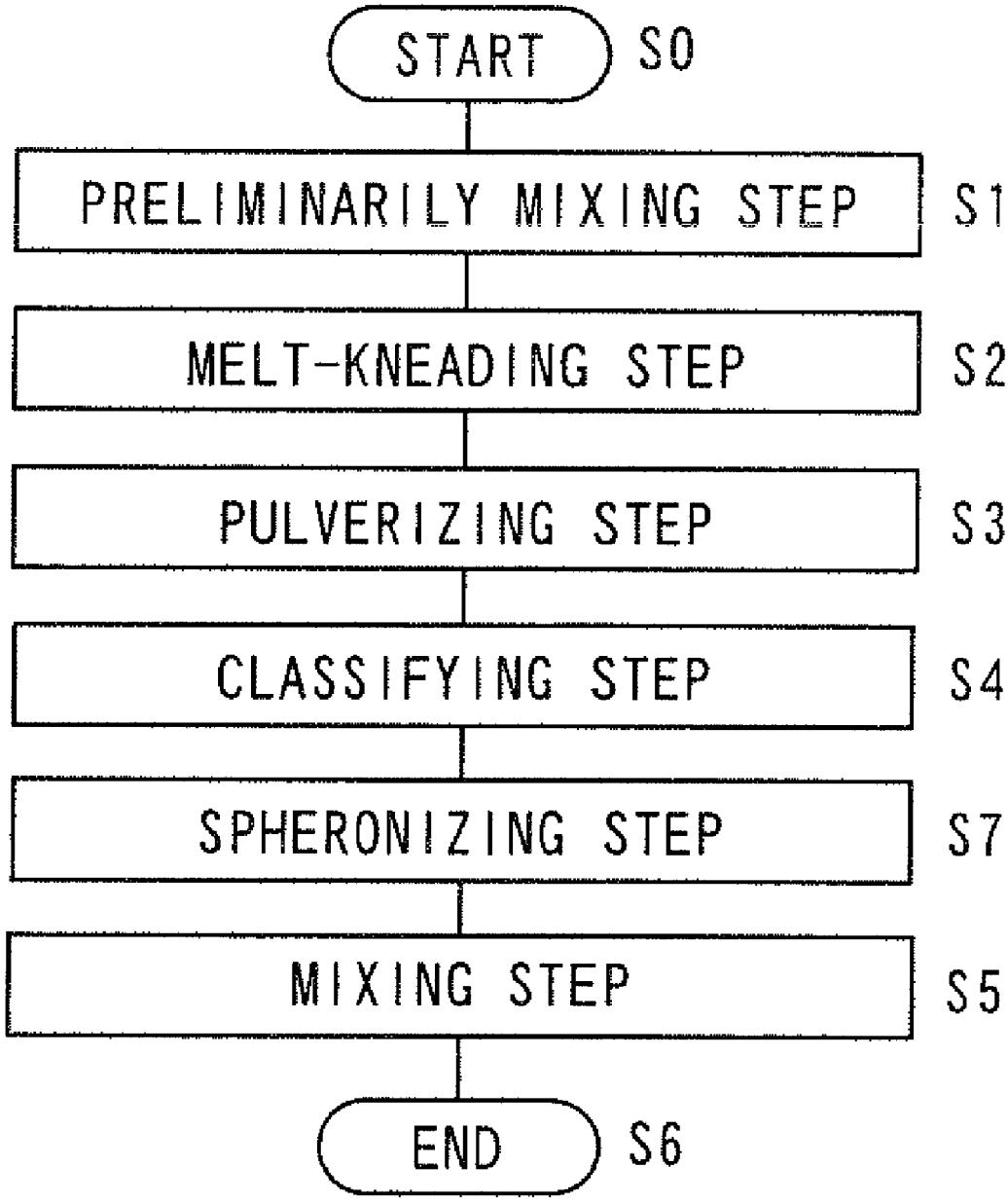
FIG. 2 is a flowchart showing one example of procedure in a method of manufacturing a toner of the invention.

A method of manufacturing the toner of the invention will be explained hereinbelow. FIGS. 1 and 2 are flowcharts each showing one example of procedure in the method of manufacturing the toner of the invention. Note that in FIG. 2, elements the same as those in FIG. 1 are denoted by the same reference symbols, and explanation of such elements will be omitted. As shown in FIG. 1, the method of manufacturing a toner of the invention includes a preliminarily miring step (Step S1) of mixing at least binder resin and colorant into a mixture, a melt-kneading step (Step S2) of melt-kneading the mixture into a melt-kneaded product, a pulverizing step (Step S3) of pulverizing the melt-kneaded product into a pulverized product, a classifying step (Step S4) of classifying the pulverized product into a large-sized toner particle group of particles and a small-sized toner particle group of particles having a volume average particle size smaller than that of the large-sized toner particle group of particles, and a mixing step (Step S5) of mixing the large-sized toner particle group of particles and the small-sized toner particle group of particles.

The respective manufacturing steps of Step S1 to Step S5 will be explained in detail below. The shift from Step S0 to Step S1 initiates the manufacture of the tone of the invention.

[Preliminary Mixing Step]

In preliminary mixing step S1, at least binder resin and colorant are dry-mixed with each other by a mixer into a mixture. In the toner, other toner additive components may be contained with the binder resin and the colorant. The other toner additive components include, for example, a release agent and a charge control agent. For theses components, ingredients and usage thereof are not particularly limited, and known substances may be used in general amount.

For the mixer used for dry-mixing, a known mixer can be used including, for example, a Henschel-type mixing device such as FMMIXER (trade name) manufactured by Mitsui Mining Co., Ltd., SUPERMIXER (trade name) manufactured by Kawata MFG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

The toner ingredients will be explained below.

(a) Binder Resin

The binder resin is not particularly limited, and the binder resin for black toner or color toner may be used. Examples of the binder resin include: polyester resin; styrene resin such as polystyrene and styrene-acrylic ester copolymer resin; acrylic resin such as polymethylmethacrylate; polyolefin resin such as polyethylene; polyurethane resin; and epoxy resin. Also usable is resin obtained by polymerization reaction of an ingredient monomer mixture and the release agent which are mixed with each other. The binder resin may be used each alone, or two or more thereof may be used in combination. The binder resin preferably contains polyester resin in particular among the above examples. Polyester resin is, as compared to other resins such as acrylic resin, excellent in durability and transparency as well as being low in a softening temperature (Tm). A toner containing polyester resin as binder resin can be accordingly excellent in durability and color appearance. Furthermore, the toner has an excellent low-temperature fixing property, that is, the toner can be fixed at lower temperature.

A glass transition temperature (Tg) of the binder resin is not particularly limited and may be appropriately selected from a wide range. In view of a fixing property and preservation stability of the toner to be obtained, the glass transition temperature (Tg) is preferably 30° C. or more and 80° C. or less. The binder resin having a glass transition temperature (Tg) less than 30° C. may lead to insufficient preservation stability which increasingly causes thermal aggregation of the toner inside an image forming apparatus, possibly generating a development failure. Further, in this case, high-temperature offset phenomenon will occur at lower temperature. The temperature at start of the high-temperature offset phenomenon will be hereinafter referred to as "high-temperature offset start temperature". The high-temperature offset phenomenon means a phenomenon indicating removal of a part of the toner which part is attached to a fixing member such as a heating roller when the toner layer is split due to the aggregating forces of toner particles decreasing to be lower than the adhesion between the toner and the fixing member since the toner is excessively heated during fixing operation that the toner is heated and pressurized by the fixing member to be fixed to a recording medium. Further, the binder resin having a glass transition temperature (Tg) exceeding 80° C. may decrease the fixing property, thus causing a fixing failure.

A softening temperature ($T_m$) of the binder resin is not particularly limited and may be appropriately selected from a wide range, being preferably 150° C. or less and more preferably 60° C. or more and 150° C. or less. The binder resin having a softening temperature ($T_m$) less than 60° C. may decrease the preservation stability of the toner and increasingly cause the thermal aggregation of the toner particles inside the image forming apparatus, causing a failure to stably supply the toner to an image bearing member and thus causing a development failure. Further, malfunction of the image forming apparatus may be induced. The binder resin having a softening temperature ($T_m$) exceeding 150° C. is less easily molten in the melt-kneading step, therefore making it difficult to knead the toner ingredients and possibly leading to a decrease in the dispersibility of the colorant, release agent, and charge control agent in the melt-kneaded product. Furthermore, the toner becomes less easily molten or softened when being fixed to a recording medium and therefore, a fixing property of the toner to the recording medium may decrease and thus cause a fixing failure.

(b) Colorant

Examples of the colorant include yellow toner colorant, magenta toner colorant, cyan toner colorant, and black toner colorant.

The yellow toner colorant includes, for example, azo pigments such as C.I. pigment yellow 1, C.I. pigment yellow 5, C.I. pigment yellow 12, C.I. pigment yellow 15, and C.I. pigment yellow 17; inorganic pigment such as yellow iron oxide and yellow ocher; nitro dye such as C.I. acid yellow 1; and oil-soluble dye such as C.I. solvent yellow 2, C.I. solvent yellow 6, C.I, solvent yellow 14, C.I. solvent yellow 15, C.I. solvent yellow 19, and C.I. solvent yellow 21, which are all classified according to color index.

The magenta toner colorant includes, for example, C.I. pigment red 49, C.I. pigment red 57:1, C.I. pigment red 57, C.I. pigment red 81, C.I. pigment red 122, C.I. solvent red 19, C.I. solvent red 49, C.I. solvent red 52, C.I. basic red 10, and C.I. disperse red 15, which are all classified according to color index.

The cyan toner colorant includes, for example, C.I. pigment blue 15, C.I. pigment blue 16, C.I. solvent blue 55, C.I. solvent blue 70, C.I. direct blue 25, and C.I. direct blue 86.

The black toner colorant includes, for example, carbon black such as channel black, roller black, disk black, gas furnace black, oil furnace black, thermal black, and acetylene black. Among these carbon black, suitable carbon black may be appropriately selected according to design characteristics of the toner to be obtained.

Other than these pigments, a purple pigment, a green pigment, and the like may be used. The colorant may be used each alone, and two or more thereof may be used in combination. Further, it is possible to use two or more of the colorants of the same color series and also possible to use one or two or more colorants respectively from different color series.

The colorant is preferably used in form of a master batch. The master batch of the colorant can be manufactured by kneading a molten product of synthetic resin and the colorant. For the synthetic resin, resin is used of the same sort as that of the binder resin of the toner or being highly compatible with the binder resin of the toner. A usage of the colorant in the master batch is not particularly limited and is preferably 30 parts by weight or more and 100 parts by weight or less based on 100 parts of the synthetic resin, or 23% by weight or more and 50% by weight or less based on 100% by weight of the master batch. The master batch is used, for example, with particles granulated to around 2 mm or more and 3 mm or less in diameter.

A content of the colorant in the toner of the invention is not particularly limited, and is preferably 4 parts by weight or more and 20 parts by weight or less based on 100 parts by weight of the binder resin. In the case of using the master batch, a usage of the master batch is preferably adjusted so that a content of the colorant in the toner of the invention falls in the above range. When the usage of the colorant falls in the above range, it is possible to form a favorable image having sufficient image density and high color appearance with excellent image quality.

(c) Release Agent

The toner of the invention may contain a release agent as a toner additive component with the binder resin and the colorant and thereby enhance the effect of preventing the offset phenomena. The release agent includes, for example, petroleum wax such as paraffin wax and derivatives thereof, and microcrystalline wax and derivatives thereof; hydrocarbon-based synthetic wax such as Fischer-Tropsch wax and derivatives thereof, polyolefin wax and derivatives thereof, low-molecular-weight polypropylene wax and derivatives thereof, and polyolefinic polymer wax and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amides and phenolic fatty acid esters; long-chain carboxylic acids and derivatives thereof; long-chain alcohols and derivatives thereof; silicone polymers; and higher fatty acids. Note that examples of the derivatives include oxides, block copolymers of a vinylic monomer and wax, and copolymers of a vinylic monomer and wax. A usage of the release agent is not particularly limited and may be appropriately selected from a wide range, and preferably is 0.2 part by weight or more and 20 parts by weight or less based on 100 parts by weight of the binder resin.

A melting temperature of the release agent is preferably 50° C. or more and 150° C. or less and more preferably 120° C. or less. The release agent having a melting temperature less than 50° C. may be molten and cause toner particle-to-particle aggregation inside a developing device or may cause a failure such as the toner filming on a surface of an image bearing member. The release agent having a melting temperature exceeding 150° C. may not be able to sufficiently elute when the toner is fixed to a recording medium, possibly causing a failure to exert a sufficient effect of enhancing the anti-high-temperature offset property. The melting temperature of the release agent represents a temperature at an endothermic peak corresponding to meltdown of the DSC curve obtained through measurement of differential scanning calorimetry (abbreviated as "DSC").

(d) Charge Control Agent

The toner of the invention may contain a charge control agent as a toner additive component with the binder resin and the colorant and thereby have frictional charge quantity of the toner in a preferable range. The usable charge control agent includes a positive charge control agent and a negative charge control agent. The positive charge control agent includes, for example, a basic dye, quaternary ammonium salt, quaternary phosphonium salt, aminopyrine, a pyrimidine compound, a polynuclear polyamino compound, aminosilane, a nigrosine dye, a derivative thereof, a triphenylmethane derivative, guanidine salt, and amidine salt. The negative charge control agent includes oil-soluble dyes such as oil black and spiron black, a metal-containing azo compound, an azo complex dye, metal salt naphthenate, salicylic acid, metal complex and metal salt (the metal includes chrome, zinc, and zirconium) of a salicylic acid derivative, a boron compound, a fatty acid soap, long-chain alkylcarboxylic acid salt, and a resin acid soap. The charge control agents may be used each alone, or two or more thereof may be used in combination. A usage of the charge control agent is not particularly limited and may be appropriately selected from a wide range, and is preferably 0.5 part by weight or more and 3 parts by weight or less based on 100 parts by weight of the binder resin.

[Melt-kneading Step]

In the melt-kneading step S2, the mixture prepared in the preliminary mixing step is melt-kneaded into a melt-kneaded product. In melt-kneading the mixture, the mixture is heated to a temperature equal to or higher than the softening temperature of the binder resin and lower than the decomposition temperature of the binder resin to thereby melt or soften the binder resin in which the toner ingredients other than the binder resin will be then dispersed.

For the melt-kneading operation, a known kneading device can be used including, for example, a kneader, a twin-screw extruder, a two roll mill, a three roll mill, and a laboplast mill. Specific examples of such a kneading device include single or twin screw extruders such as TEM-100B (trade name) manufactured by Toshiba Machine Co., Ltd., PCM-65, PCM-65/87 and PCM-30, all of which are trade names and manufactured by Ikegai Ltd., and open roll-type kneading machines such as KNEADEX (trade name) manufactured by Mitsui Mining Co., Ltd. Among these kneaders, the open roll-type kneading machines are preferred. The mixture of the toner ingredients may be melt-kneaded by using a plurality of the kneading devices.

[Pulverizing Step]

In the pulverizing step S3, the melt-kneaded product obtained in the melt-kneading step is cooled to be solidified and then pulverized into a pulverized product. The melt-kneaded product cooled and solidified is firstly pulverized by a hammer mill, a cutting mill, or the like device, into a coarsely pulverized product having a volume average particle size of around 100 μm or more and 5 mm or less, for example. After then, the coarsely pulverized product thus obtained are furthermore pulverized into a finely pulverized product having a volume average particle size of 15 μm or less, for example. For finely pulverizing the coarsely pulverized product, usable are, for example, a jet-type pulverizer using supersonic jet stream for the pulverization, and an impact-type pulverizer in which the coarsely pulverized product is introduced into a space formed between a rotor rotating at high speed and a stator (linear) and then pulverized therein.

Note that the melt-kneaded product cooled and solidified does not have to be coarsely pulverized by the hammer mill, the cutting mill, or the like device before pulverized by the jet-type pulverizer, the impact-type pulverizer, or the like device.

[Classifying Step]

In the classifying step S4, the pulverized product prepared in the pulverizing step is classified into, for example, excessively pulverized toner particles having a volume average particle size of 3.0 μm or less, a large-sized toner particle group of particles, and a small-sized toner particle group of particles having a volume average particle size smaller than that of the large-sized toner particle group of particles. The excessively pulverized toner particles can be collected and reused to manufacture other toners.

For the classification, a known classifier is usable by which the excessively pulverized toner can be removed through classification using centrifugal force or wind force. The known classifier includes, for example, a swivel pneumatic classifier (rotary pneumatic classifier).

The classification is preferably carried out under appropriately adjusted classification conditions so that the volume average particle size of the large-sized toner particle group of particles resulting from the classification is 6 μm or more and 9 μm or less. When the large-sized toner particle group of particles has the volume average particle size of 6 μm or more and 9 μm or less as above, the contents of the coarse toner particles and fine toner particles based on the entire toner particles can be easily adjusted to fall in the favorable ranges, thus allowing for easy manufacture of the toner of the invention which is excellent in fluidity and capable of forming a high-quality image having high definition and high resolution. When the volume average particle size of the large-sized toner particle group of particles is less than 6 μm, fluidity and transfer efficiency degrade, which situation may cause toner scattering, fogging, or the like trouble and moreover lead to a decrease in the cleaning property. Worse still, it may became difficult to manufacture the toner. When the volume average particle size of the large-sized toner particle group of particles is more than 9 μm, the volume average particle size of the entire toner particles is so large that an image formed of such toner particles may not be high in the definition.

Further, the classification is preferably carried out under appropriately adjusted classification conditions so that the volume average particle size of the small-sized toner particle group of particles resulting from the classification is 3.5 μm or more and less than 6 μm. This makes it possible to easily adjust the contents of the coarse toner particles and fine toner particles based on the entire toner particles to fall in the favorable ranges, thus allowing for easy manufacture of the toner of the invention which is excellent in fluidity and capable of forming a high-quality image having high definition and high resolution. When the volume average particle size of the small-sized toner particle group of particles is less than 3.5 μm, the classification is difficult, possibly making it difficult to manufacture the toner. When the volume average particle size of the small-sized toner particle group of particles is more than 6 μm, an image formed of the resultant toner may have degraded resolution, thus resulting in a failure to obtain a high-quality image of sufficiently high definition and resolution.

The above-stated classification conditions to be adjusted include, for example, a rotation speed of a classification rotor in the swivel pneumatic classifier (rotary pneumatic classifier).

[Mixing Step]

In the mixing step S5, the large-sized toner particle group of particles and the small-sized toner particle group of particles are mixed with each other by a mixer, whereby a toner is manufactured. In the mixing step, a mixing ratio of the large-sized toner particle group of particles to the small-sized toner particle group of particles is preferably from 3.4:10 to 30:10, and more preferably from 6:10 to 26:10.

By mixing the large-sized toner particle group of particles and the small-sized toner particle group of particles in the above mixing ratio, the toner can be adjusted so as to have entire toner particles having a volume average particle size of 4 μm or more and 8 μm or less, and contain the coarse toner particles of 24% by volume or more and 47% by volume or less based on the entire toner particles with the fine toner particles of 10% by number or more and 50% by number or less based on the entire toner particles.

The contents of the coarse toner particles and the fine toner particles in the toner based on the entire toner particles can be thus more reliably adjusted to fall in the favorable ranges, and it is therefore possible to more reliably manufacture the toner of the invention which is excellent in fluidity and capable of forming a high-quality image having high definition and high resolution. When the mixing ratio of the large-sized toner particle group of particles is less than 3.4 relative to that of the small-sized toner particle group of particles assumed to be 10, the resolution may degrade, possibly resulting in a failure to obtain a high-quality image of sufficiently high definition and resolution. When the mixing ratio of the large-sized toner particle group of particles is more than 30 relative to that of the small-sized toner particle group of particles assumed to be 10, the fluidity and the transfer efficiency degrade, which situation may cause toner scattering, fogging, or the like trouble and moreover lead to a decrease in the cleaning property.

For the mixer used for the mixing operation, a known mixer can be used including, for example, a Henschel-type mixing device such as FMMIXER (trade name) manufactured by Mitsui Mining Co., Ltd., SUPERMIXER (trade name) manufactured by Kawata MFG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

With the toner manufactured as above, an external additive may be mixed having functions such as enhancing powder fluidity, enhancing frictional chargeability, enhancing heat resistance, improving long-term, preservation stability, improving a cleaning property, and controlling a wear characteristic of photoreceptor surface. Examples of the external additive include fine silica powder, fine titanium oxide powder, and fine aluminum powder. The external additive may be used each alone, or two or more thereof may be used in combination. An amount of the external additive to be added is preferably 0.1 part by weight or more and 10 parts by weight or less and more preferably 0.1 part by weight or more and 2 parts by weight or less based on 100 parts by weight of the toner in view of charge quantity required for the toner, influence on photoreceptor wear through addition of the external additive, environmental characteristics of the toner, and the like elements. Note that the external additive may be added to the large-sized toner particle group of particles and the small-sized toner particle group of particles, respectively, before these groups of particles are mixed with each other in the mixing step.

[Spheronizing Step]

Note that the method of manufacturing the toner of the invention preferably includes the spheronizing step S7 between the classifying step S4 and the mixing step S5 as shown in FIG. 2. In the spheronizing step S7, at least one of the large-sized toner particle group of particles and the small-sized toner particle group of particles is treated with a spheronization process. In particular, it is preferred that the small-sized toner particle group of particles be treated with a spheronization process.

When the spheronizing step is provided and at least one of the large-sized toner particle group of particles and the small-sized toner particle group of particles is treated with the spheronization process as stated above, the average degree of circularity and circularity distribution of the entire toner particles can be controlled, thus resulting in the toner particles having favorable shapes. Consequently, the toner thus manufactured is capable of maintaining the transfer efficiency at high level and stably forming high-quality images. In the case where no spheronizing step is provided, the content of the irregularly-shaped toner particles based on the entire toner particles is high, leading to lower transfer efficiency which may result in a failure to stably from high-quality images.

Examples of the spheronization processing method include a spheronizing method using mechanical impact and a spheronizing method using hot air.

A usable example of the impact-type spheronizing device for the spheronizing method using mechanical impact is a commercially-available device including FACULTY (trade name) manufactured by Hosokawa Micron Corporation.

A usable example of the hot-air-type spheronizing device for the spheronizing method using hot air is a commercially-available device including a surface modifying system: METEORAINBOW (trade name) manufactured by Nippon Pneumatic MFG. Co., Ltd.

When the mechanical impact or hot air is used for the spheronization process in the spheronizing step as above, the average degree of circularity and circularity distribution of the entire toner particles can be controlled, thus resulting in the toner particles having favorable shapes. Consequently, the toner thus manufactured is capable of more easily maintaining the transfer efficiency at high level and stably forming high-quality images.

After completion of the mixing step, the procedure is shifted from Step S5 to Step S6 where the manufacture of the toner of the invention ends.

By using the above method of manufacturing a toner to manufacture the toner of the invention, it is possible to manufacture a toner which is excellent in fluidity and capable of forming a high-quality image of high definition and high resolution.

The toner of the invention manufactured as above can be used as one-component developer without change and can also be mixed with a carrier to be used in form of two-component developer.

For the carrier, magnetic particles can be used. Specific examples of the magnetic particles include metals such as iron, ferrite, and magnetite; and alloys composed of the metals just cited and metals such as aluminum or lead. Among these examples, ferrite is preferred.

Further, the carrier can be a resin-coated carrier in which the magnetic particles are coated with resin, or a dispersed-in-resin carrier in which the magnetic particles are dispersed in resin. The resin for coating the magnetic particles is not particularly limited and includes, for example, olefin-based resin, styrene-based resin, styrene-acrylic resin, silicone-based resin, ester-based resin, and fluorine-containing polymer-based resin. The resin used for the dispersed-in-resin carrier is not particularly limited either and includes, for example, styrene-acrylic resin, polyester-based resin, fluorine-based resin, and phenol-based resin.

A shape of the carrier is preferably spherical or oblong. Further, a particle size of the carrier is not particularly limited. In consideration of enhancement in image quality, the particle size of the carrier is preferably 10 μm or more and 100 μm or less and more preferably 20 μm or more and 50 μm or less. Furthermore, resistivity of the carrier is preferably $10^8$ Ω·cm or more and more preferably $10^{12}$ Ω·cm or more. The resistivity of the carrier is a current value obtained in a manner that the carrier is put in a container having a sectional area of 0.50 $cm^2$ followed by tapping, and a load of 1 $kg/cm^2$ is then applied to the particles put in the container, thereafter being subjected to application of voltage which generates an electric field of 1,000 V/cm between the load and a bottom electrode. When the resistivity of the carrier is small, application of bias voltage to a developing roller will cause charges to be injected to the carrier, which makes the carrier particles be easily attached to the photoreceptor. Further, in this case, breakdown of the bias voltage occurs more easily.

Magnetization intensity (maximum magnetization) of the carrier is preferably 10 emu/g to 60 emu/g and more preferably 15 emu/g to 40 emu/g. The magnetization intensity depends on magnetic flux density of the developing roller. Under a condition that the developing roller has normal magnetic flux density, the magnetization intensity less than 10 emu/g will lead to a failure to exercise magnetic binding force, which may cause the carrier to be spattered. When the magnetization intensity exceeds 60 emu/g, it becomes difficult to keep a noncontact state with the photoreceptor serving as the image bearing member in a noncontact development where brush of the carrier is too high, and in a contact development, sweeping patterns may appear more frequently in a toner image.

A usage between the toner and the carrier contained in the two-component developer is not particularly limited and may be appropriately selected according to kinds of the toner and carrier. To take the case of the resin-coated carrier (having density of 5 $g/cm^2$ to 8 $g/cm^2$) as an example, it is preferable to use the toner in such an amount that the content of the toner in the two-component developer is 2% by weight or more and 30% by weight or less and preferably 2% by weight or more and 20% by weight or less based on a total amount of the two-component developer. To take the case of a ferrite carrier as an example, it is preferable to use the toner in such an amount that coverage of the toner over the carrier in the two-component developer is 40% or more and 80% or less.

The two-component developer of the invention thus contains the carrier and the toner of the invention which is excellent in fluidity and capable of forming a high-quality image of high definition and high resolution, thereby allowing for reduced variations of charge distribution, with the result that a good developing property can be maintained.

[Image Forming Apparatus]

Figure 3:
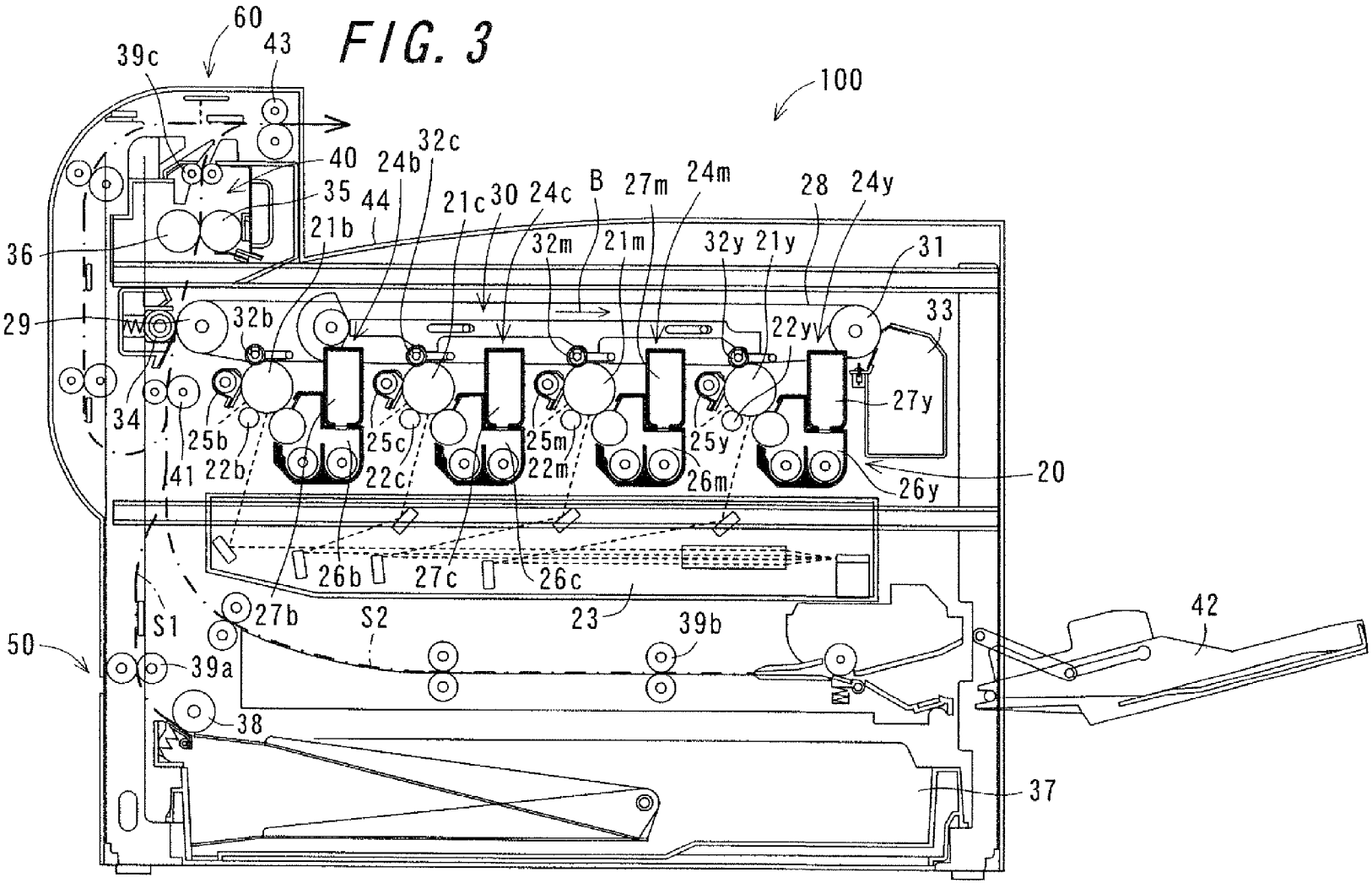
FIG. 3 is a view schematically showing one example of a configuration of an image forming apparatus of the invention.

FIG. 3 is a view schematically showing one example of a configuration of an image forming apparatus 100 of the invention. The image forming apparatus 100 is a multifunction printer having a copier function, a printer function, and a facsimile function together, and according to image information being conveyed to the image forming apparatus 100, a full-color or monochrome image is formed on a recording medium. That is, the image forming apparatus 100 has three types of print mode, i.e., a copier mode, a printer mode and a FAX mode, and the print mode is selected by a control unit (not shown) in accordance with, for example, the operation input from an operation portion (not shown) and reception of the printing job from a personal computer, a mobile device, an information recording storage medium, and an external equipment using a memory device. The image forming apparatus 100 includes a toner image forming section 20, a transfer section 30, a fixing section 40, a recording medium feeding section 50, and a discharging section 60. In accordance with image information of respective colors of black (b), cyan (c), magenta (m), and yellow (y) which are contained in color image information, there are provided respectively four sets of the components constituting the toner image forming section 20 and some parts of the components contained in the transfer section 30. The four sets of respective components provided for the respective colors are distinguished herein by giving alphabets indicating the respective colors to the end of the reference numerals, and in the case where the sets are collectively referred to, only the reference numerals are shown.

The toner image forming section 20 includes a photoreceptor drum 21, a charging section 22, an exposure unit 23, a developing device 24, and a cleaning unit 25. The charging section 22, the developing device 24, and the cleaning unit 25 are disposed around the photoreceptor drum 21 in the order just stated. The charging section 22 is disposed vertically below the developing section 24 and the cleaning unit 25.

The photoreceptor drum 21 is an image bearing member which is rotatably supported around an axis thereof by a drive section (not shown) and includes a conductive substrate (not shown) and a photosensitive layer (not shown) formed on a surface of the conductive substrate. The conductive substrate may be formed into various shapes such as a cylindrical shape, a circular columnar shape, and a thin film sheet shape. Among these shapes, the cylindrical shape is preferred. The conductive substrate is formed of a conductive material. As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film in which a conductive layer containing one or two or more of aluminum, aluminum alloy, tin oxide, gold, indium oxide, etc. is formed on a film-like substrate such as a synthetic resin film, a metal film, and paper; and a resin composition containing at least conductive particles or conductive polymers. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. When the undercoat layer is provided, the flaws and irregularities present on the surface of the conductive substrate are covered, leading to advantages such that the photosensitive layer has a smooth surface, that chargeability of the photosensitive layer can be prevented front degrading during repetitive use, and that the charging property of the photosensitive layer can be enhanced under at least either a low temperature circumstance or a low humidity circumstance. Further, the photosensitive layer may be a laminated photoreceptor having a highly-durable three-layer structure in which a photoreceptor surface-protecting layer is provided on the top layer.

The charge generating layer contains as a main ingredient a charge generating substance that generates charges under irradiation of light, and optionally contains known binder resin, plasticizer, sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generating ability and are suitable for forming a highly-sensitive photosensitive layer. The charge generating substances may be used each alone, or two or more of them may be used in combination. The content of the charge generating substance is not particularly limited, and preferably from 5 parts by weight to 500 parts by weight and more preferably from 10 parts by weight to 200 parts by weight based on 100 parts by weight of the binder resin in the charge generating layer. Also as the binder resin for charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, polyallylate, polyamide, and polyester. The binder resins may be used each alone or, optionally, two or more of them may be used in combination.

The charge generating layer can be formed by dissolving or dispersing an appropriate amount of a charge generating substance, binder resin and, optionally, a plasticizer, a sensitizer, etc. respectively in an appropriate organic solvent which is capable of dissolving or dispersing the ingredients described above, to thereby prepare a coating solution for charge generating layer, and then applying the coating solution for charge generating layer to the surface of the conductive substrate, followed by drying. The thickness of the charge generating layer obtained in this way is not particularly limited, and preferably from 0.05 μm to 5 μm and more preferably from 0.1 μm to 2.5 μm.

The charge transporting layer stacked over the charge generating layer contains as essential ingredients a charge transporting substance having an ability of receiving and transporting charges generated from the charge generating substance, and binder resin for charge transporting layer, and optionally contains known antioxidant, plasticizer, sensitizer, lubricant, etc. As the charge transporting substance, materials used customarily in the relevant field can be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl) anthracene, 1,1-bis(4-dibenzylaminophenyl)propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, bromanil, chloranil, and benzoquinone. The charge transporting substances may be used each alone, or two or more of them may be used in combination. The content of the charge transporting substance is not particularly limited, and preferably from 10 parts by weight to 300 parts by weight and more preferably from 30 parts by weight to 150 parts by weight based on 100 parts by weight of the binder resin in the charge transporting layer. As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resin thereof. Among those materials, in view of the film forming property, and the wear resistance, an electrical property etc. of the obtained charge transporting layer, it is preferable to use, for example, polycarbonate which contains bisphenol Z as the monomer ingredient (hereinafter referred to as "bisphenol Z polycarbonate", and a mixture of bisphenol Z polycarbonate and other polycarbonate. The binder resins may be used each alone, or two or more of them may be used in combination.

The charge transporting layer preferably contains an antioxidant together with the charge transporting substance and the binder resin for charge transporting layer. Also for the antioxidant, materials used customarily in the relevant field can be used including, for example, Vitamin E, hydroquinone, hindered amine, hindered phenol, paraphenylene diamine, arylalkane and derivatives thereof, an organic sulfur compound, and an organic phosphorus compound. The antioxidants may be used each alone, or two or more of them may be used in combination. The content of the antioxidant is not particularly limited, and is 0.01% by weight to 10% by weight and preferably 0.05% by weight to 5% by weight of the total amount of the ingredients constituting the charge transporting layer. The charge transporting layer can be formed by dissolving or dispersing an appropriate amount of a charge transporting substance, binder resin and, optionally, an antioxidant, a plasticizer, a sensitizer, etc. respectively in an appropriate organic solvent which is capable of dissolving or dispersing the ingredients described above, to thereby prepare a coating solution for charge transporting layer, and applying the coating solution for charge transporting layer to the surface of a charge generating layer followed by drying. The thickness of the charge transporting layer obtained in this way is not particularly limited, and preferably 10 μm to 50 μm and more preferably 15 μm to 40 μm. Note that it is also possible to form a photosensitive layer in which a charge generating substance and a charge transporting substance are present in one layer. In this case, the kind and content of the charge generating substance and the charge transporting substance, the kind of the binder resin, and other additives may be the same as those in the case of forming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like.

The charging section 22 faces the photoreceptor drum 21 and is disposed away from the surface of the photoreceptor drum 21 when viewed in a longitudinal direction of the photoreceptor drum 21. The charging section 22 charges the surface of the photoreceptor drum 21 so that the surface of the photoreceptor drum 21 has predetermined polarity and potential. As the charging section 22, it is possible to use a charging brush type charging device, a charger type charging device, a pin array type charging device, an ion-generating device, etc. Although the charging section 22 is disposed away from the surface of the photoreceptor drum 21 in the embodiment, the configuration is not limited thereto. For example, a charging roller may be used as the charging section 22, and the charging roller may be disposed in pressure-contact with the photoreceptor drum 21. It is also possible to use a contact-charging type charger such as a charging brush or a magnetic brush.

The exposure unit 23 is disposed so that light beams corresponding to each color information emitted from the exposure unit 23 passes between the charging section 22 and the developing section 24 and reaches the surface of the photoreceptor drum 21. In the exposure unit 23, the image information is converted into light beams corresponding to each color information of black (b), cyan (c), magenta (m), and yellow (y), and the surface of the photoreceptor drum 21 which has been evenly charged by the charging section 22, is exposed to the light beams corresponding to each color information to thereby form electrostatic latent images on the surfaces of the photoreceptor drums 21. As the exposure unit 23, it is possible to use a laser scanning unit having a laser-emitting portion and a plurality of reflecting mirrors. The other usable examples of the exposure unit 23 may include an LED array and a unit in which a liquid-crystal shutter and a light source are appropriately combined with each other.

Figure 4:
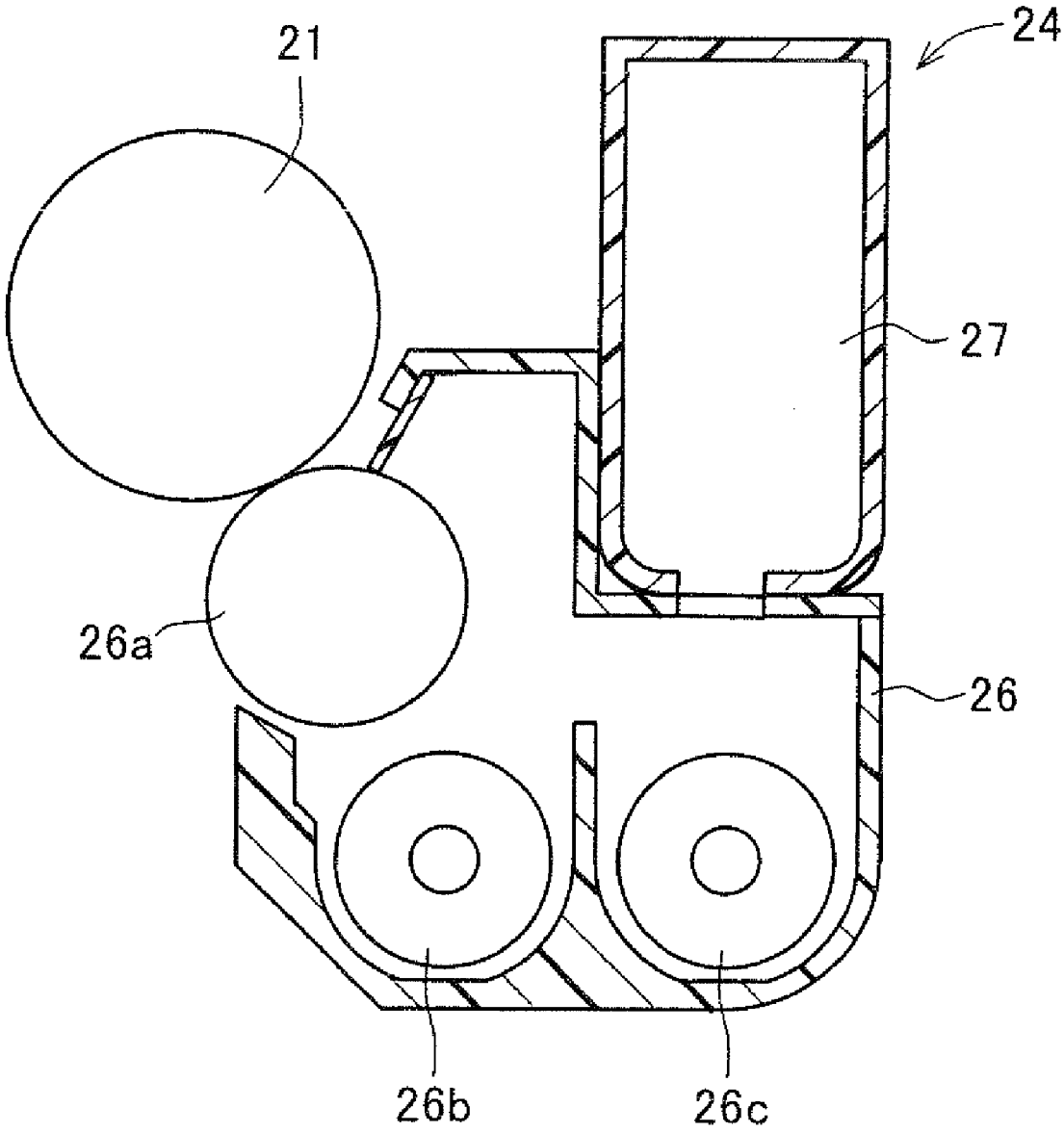
FIG. 4 is a view schematically showing one example of a configuration of a developing device of the invention.

FIG. 4 is a sectional view schematically showing one example of a configuration of the developing device 24 of the invention. The developing section 24 includes a developing tank 26 and a toner hopper 27. The developing tank 26 is a container-shaped member which is disposed so as to face the surface of the photoreceptor drum 21 and used to supply a toner to an electrostatic latent image formed on the surface of the photoreceptor drum 21 so as to develop the electrostatic latent image into a visualized image, i.e. a toner image. The developing tank 26 contains in an internal space thereof the toner, and rotatably supports roller members such as a developing roller 26*a*, a supplying roller 26*b*, and an agitating roller 26*c*, or screw members, which roller or screw members are contained in the developing tank 26. The developing tank 26 has an opening in a side face thereof opposed to the photoreceptor drum 21. The developing roller 26*a* is rotatably provided at such a position as to face the photoreceptor drum 21 through the opening just stated. The developing roller 26*a* is a roller-shaped member for supplying a toner to the electrostatic latent image on the surface of the photoreceptor drum 21 in a pressure-contact portion or most-adjacent portion between the developing roller 26*a* and the photoreceptor drum 21. In supplying the toner, to a surface of the developing roller 26*a* is applied potential whose polarity is opposite to polarity of the potential of the charged toner, which serves as development bias voltage. By so doing, the toner on the surface of the developing roller 26*a* is smoothly supplied to the electrostatic latent image. Furthermore, an amount of the toner being supplied to the electrostatic latent image (which amount is referred to as "toner attachment amount") can be controlled by changing a value of the development bias voltage. The supplying roller 26*b* is a roller-shaped member which is rotatably disposed so as to face the developing roller 26*a* and used to supply the toner to the vicinity of the developing roller 26*a*. The agitating roller 26*c* is a roller-shaped member which is rotatably disposed so as to face the supplying roller 26*b* and used to feed to the vicinity of the supplying roller 26*b* the toner which is newly supplied from the toner hopper 27 into the developing tank 26. The toner hopper 27 is disposed so as to communicate a toner replenishment port (not shown) formed in a vertically lower part of the toner hopper 27, with a toner reception port (not shown) formed in a vertically upper part of the developing tank 26. The toner hopper 27 replenishes the developing tank 26 with the toner according to toner consumption. Further, it may be possible to adopt such configuration that the developing tank 26 is replenished with the toner supplied directly from a toner cartridge of each color without using the toner hopper 27.

The cleaning unit 25 removes the toner which remains on the surface of the photoreceptor drum 21 after the toner image has been transferred to the recording medium, and thus cleans the surface of the photoreceptor drum 21. In the cleaning unit 25, a platy member is used such as a cleaning blade. In the image forming apparatus of the invention, an organic photoreceptor drum is mainly used as the photoreceptor drum 21. A surface of the organic photoreceptor drum contains a resin component as a main ingredient and therefore tends to be degraded by chemical action of ozone which is generated by corona discharging of the charging section 22. The degraded surface part is, however, worn away by abrasion through the cleaning unit 25 and thus removed reliably, though gradually. Accordingly, the problem of the surface degradation caused by the ozone, etc. is actually solved, and it is thus possible to stably maintain the potential of charges given by the charging operation over a long period of time. Although the cleaning unit 25 is provided in the embodiment, no limitation is imposed on the configuration and the cleaning unit 25 does not have to be provided.

In the toner image forming section 20, signal light corresponding to the image information is emitted from the exposure unit 23 to the surface of the photoreceptor drum 11 which has been evenly charged by the charging section 22, thereby forming an electrostatic latent image; the toner is then supplied from the developing section 24 to the electrostatic latent image, thereby forming a toner image; the toner image is transferred to an intermediate transfer belt 28; and the toner which remains on the surface of the photoreceptor drum 21 is removed by the cleaning unit 25. A series of toner image forming operations just described are repeatedly carried out.

The transfer section 30 is disposed above the photoreceptor drum 21 and includes the intermediate transfer belt 28, a driving roller 29, a driven roller 31, an intermediate transfer roller 32*b*, 32*c*, 32*m*, 32*y*, a transfer belt cleaning unit 33, and a transfer roller 34. The intermediate transfer belt 28 is an endless belt stretched between the driving roller 29 and the driven roller 31, thereby forming a loop-shaped travel path. The intermediate transfer belt 28 rotates in an arrow B direction, that is, a direction in which a surface of intermediate transfer belt 28 in contact with the photoreceptor drum 21 moves from the photoreceptor drum 21*y* to the photoreceptor drum 21*b*.

When the intermediate transfer belt 28 passes by the photoreceptor drum 21 in contact therewith, the transfer bias voltage whose polarity is opposite to the polarity of the charged toner on the surface of the photoreceptor drum 21 is applied from the intermediate transfer roller 32 which is disposed opposite to the photoreceptor drum 21 across the intermediate transfer belt 28, with the result that the toner image formed on the surface of the photoreceptor drum 21 is transferred onto the intermediate transfer belt 28. In the case of a multicolor image, the toner images of respective colors formed on the respective photoreceptor drums 21*y*, 21*m*, 21*c*, and 21*b* are sequentially transferred and overlaid onto the intermediate transfer belt 28, thus forming a multicolor toner image. The driving roller 29 can rotate around an axis thereof with the aid of a drive section (not shown), and the rotation of the driving roller 29 drives the intermediate transfer belt 28 to rotate in the arrow. B direction. The driven roller 31 can be driven to rotate by the rotation of the driving roller 29, and imparts constant tension to the intermediate transfer belt 28 so that the intermediate transfer belt 28 does not go slack. The intermediate transfer roller 32 is disposed in pressure-contact with the photoreceptor drum 21 across the intermediate transfer belt 28, and capable of rotating around an axis thereof by a drive section (not shown). The intermediate transfer roller 32 is connected to a power source (not shown) for applying the transfer bias as described above, and has a function of transferring the toner image formed on the surface of the photoreceptor drum 21 to the intermediate transfer belt 28. The transfer belt cleaning unit 33 is disposed opposite to the driven roller 31 across the intermediate transfer belt 28 so as to come into contact with an outer circumferential surface of the intermediate transfer belt 28. When the intermediate transfer belt 28 contacts the photoreceptor drum 21, the toner is attached to the intermediate transfer belt 28, some of which toner will not be transferred to a recording medium and remain on the intermediate transfer belt 28. Since the residual toner may cause contamination on a reverse side of the recording medium, the transfer belt cleaning unit 33 removes and collects the toner on the surface of the intermediate transfer belt 28. The transfer roller 34 is disposed in pressure-contact with the driving roller 29 across the intermediate transfer belt 28, and capable of rotating around an axis thereof by a drive section (not shown). In a pressure-contact portion (a transfer nip portion) between the transfer roller 34 and the driving roller 29, a toner image which has been carried by the intermediate transfer belt 28 and thereby conveyed to the pressure-contact portion is transferred onto a recording medium fed from the later-described recording medium feeding section 50. The recording medium carrying the toner image is fed to the fixing section 40. In the transfer section 30, the toner image is transferred from the photoreceptor drum 21 onto the intermediate transfer belt 28 in the pressure-contact portion between the photoreceptor drum 21 and the intermediate transfer roller 32, and by the intermediate transfer belt 28 rotating in the arrow B direction, the transferred toner image is conveyed to the transfer nip portion where the toner image is transferred onto the recording medium.

The fixing section 40 is provided downstream of the transfer section 30 along a conveyance direction of the recording medium, and contains a fixing roller 35 and a pressure roller 36. The fixing roller 35 can rotate by a drive section (not shown), and heats the toner constituting an unfixed toner image carried on the recording medium so that the toner is fused to be fixed on the recording medium. Inside the fixing roller 35 is provided a heating portion (not shown). The heating portion heats the heating roller 35 so that a surface of the heating roller 35 has a predetermined temperature (heating temperature). For the heating portion, a heater, a halogen lamp, and the like device can be used, for example. The heating portion is controlled by the later-described fixing condition control portion. In the vicinity of the surface of the fixing roller 35 is provided a temperature detecting sensor which detects a surface temperature of the fixing roller 35. A result detected by the temperature detecting sensor is written to a memory portion of the later-described control unit. On the basis of the detected result written to the memory portion, the fixing condition control portion controls the operation of the beating portion. The pressure roller 36 is disposed in pressure-contact with the fixing roller 35, and supported so as to be rotatably driven by the rotation of the fixing roller 35. The pressure roller 36 helps the toner image to be fixed onto the recording medium by pressing the toner and the recording medium when the toner is fused to be fixed on the recording medium by the fixing roller 35. A pressure-contact portion between the fixing roller 35 and the pressure roller 36 is a fixing nip portion. In the fixing section 40, the recording medium onto which the toner image has been transferred in the transfer section 30 is nipped by the fixing roller 35 and the pressure roller 36 go that when the recording medium passes through the fixing nip portion, the toner image is pressed and thereby fixed onto the recording medium under heat, whereby a toner image is formed.

The recording medium feeding section 50 includes an automatic paper feed tray 37, a pickup roller 38, conveying rollers 39*a* and 39*b*, registration rollers 41, and a manual paper feed tray 42. The automatic paper feed tray 37 is disposed in a vertically lower part of the image forming apparatus 100 and in form of a container-shaped member for storing the recording mediums. Examples of the recording medium include plain paper, color copy paper, sheets for overhead projector, and postcards. The pickup roller 38 takes out sheet by sheet the recording mediums stored in the automatic paper feed tray 37, and feeds the recording mediums to a paper conveyance path S1. The conveying rollers 39*a* are a pair of roller members disposed in pressure-contact with each other, and convey the recording medium to the registration rollers 41. The registration rollers 41 are a pair of roller members disposed in pressure-contact with each other, and feed to the transfer nip portion the recording medium fed from the conveying rollers 39*a* in synchronization with the conveyance of the toner image carried on the intermediate transfer belt 26 to the transfer nip portion. The manual paper feed tray 42 is a device storing recording mediums which are different from the recording mediums stored in the automatic paper feed tray 37 and may have any size and which are to be taken into the image forming apparatus. The recording medium taken in from the manual paper feed tray 42 passes through a paper conveyance path S2 by use of the conveying rollers 39*b*, thereby being fed to the registration rollers 41. In the recording medium feeding section 50, the recording medium supplied sheet by sheet from the automatic paper feed tray 37 or the manual paper feed tray 42 is fed to the transfer nip portion in synchronization with the conveyance of the toner image carried on the intermediate transfer belt 28 to the transfer nip portion.

The discharging section 60 includes the conveying rollers 39*c*, discharging rollers 43, and a catch tray 44. The conveying rollers 39*c* are disposed downstream of the fixing nip portion along the paper conveyance direction, and conveys toward the discharging rollers 43 the recording medium onto which the image has been fixed by the fixing section 40. The discharging rollers 43 discharge the recording medium onto which the image has been fixed, to the catch tray 44 disposed on a vertically upper surface of the image forming apparatus 100. The catch tray 44 stores the recording medium onto which the image has been fixed.

The image forming apparatus 100 includes a control unit (not shown). The control unit is disposed, for example, in an upper part of an internal space of the image forming apparatus 100, and contains a memory portion, a computing portion, and a control portion. To the memory portion of the control unit are input, for example, various set values obtained by way of an operation panel (not shown) disposed on the upper surface of the image forming apparatus 100, results detected from a sensor (not shown) etc. disposed in various portions inside the image forming apparatus 100, and image information obtained from an external equipment. Further, programs for operating various functional elements are written. Examples of the various functional elements include a recording medium determining portion, an attachment amount control portion, and a fixing condition control portion. For the memory portion, those customarily used in the relevant filed can be used including, for example, a read only memory (ROM), a random access memory (RAM), and a hard disc drive (HDD). For the external equipment, it is possible to use electrical and electronic devices which can form or obtain the image information and which can be electrically connected to the image forming apparatus 100. Examples of the external equipment include a computer, a digital camera, a television, a video recorder, a DVD (digital versatile disc) recorder, an HDDVD (high-definition digital versatile disc), a blu-ray disc recorder, a facsimile machine, and a mobile computer. The computing portion of the control unit takes out the various data (such as an image formation order, the detected result, and the image information) written in the memory portion and the programs for various functional elements, and then makes various determinations. The control portion of the control unit sends to a relevant device a control signal in accordance with the result determined by the computing portion, thus performing control on operations. The control portion and the computing portion include a processing circuit which is achieved by a microcomputer, a microprocessor, etc. having a central processing unit. The control unit contains a main power source as well as the above-stated processing circuit. The power source supplies electricity to not only the control unit but also respective devices provided inside the image forming apparatus 100.

As described above, the developing device 24 of the invention uses the two-component developer of the invention in the developing process and therefore is capable of forming a high-definition and high-resolution toner image on the photoreceptor drum 21. The image forming apparatus 100 of the invention is provided with the developing device 24 of the invention, and therefore capable of forming a high-quality image with high definition and high resolution.

EXAMPLES

Hereinafter, the invention will be specifically explained with reference to Examples and Comparative examples to which the invention is not particularly limited within its scope.

[Method of Measuring Values of Properties]

Values of properties in Examples and Comparative examples were measured as follows.

[Glass Transition Temperature (Tg) of Binder Resin]

Using a differential scanning calorimeter; DSC220 (trade name) manufactured by Seiko Electronics Inc., 1 g of a sample was heated at a temperature of which increase rate was 10° C./min based on Japanese Industrial Standards (JIS) K7121-1987, thus obtaining a DSC curve. A straight line was drawn toward a low temperature side extendedly from a base line on the high-temperature side of an endothermic peak corresponding to glass transition of the USC curve which had been obtained as above. A tangent line was also drawn at a point where a gradient thereof was maximum against a curve extending from a rising part to a top of the peak. A temperature at an intersection of the straight line and the tangent line was determined as the glass transition temperature (Tg)

[Softening Temperature (Tm) of Binder Resin]

Using a device for evaluating flow characteristics: FLOWTESTER CFT-100C (trade name) manufactured by Shimadzu Corporation, 1 g of a sample was heated at a temperature of which increase rate was 6° C./min, under load of 10 kgf/cm$^2$ ($9.8\times10^5$ Pa) so as to be pushed out of a die, and a temperature of the sample at the time when a half of the sample had flowed out of the die was determined as the softening temperature (Tm). The die used above was 1 mm in a nozzle aperture and 1 m in length.

[Melting Temperature of Release Agent]

Using the differential scanning calorimeter: DSC220 (trade name) manufactured by Seiko Electronics Inc., 1 g of a sample was heated from a temperature of 20° C. up to 200° C. at a temperature of which increase rate was 10° C./min, and then an operation of rapidly cooling down the sample from 200° C. to 20° C. was repeated twice, thus obtaining a DSC curve. A temperature obtained at a top of an endothermic peak which corresponds to the melting shown on the DSC curve obtained at the second operation, was determined as the melting temperature.

[Volume average particle size ($D_{50v}$) and contents (% by volume, % by number)]

To 50 ml of electrolyte: ISOTON II (trade name) manufactured by Beckman coulter, Inc. were added 20 mg of a sample and 1 ml of alkyl ether sulfuric ester sodium (a dispersant), which were then subjected to a three-minute dispersion treatment of an ultrasonic distributor: UH-50 (trade name) manufactured by STM Co., Ltd. at ultrasonic frequency of 20 kHz, thereby preparing a measurement sample. Particles sizes of the measurement sample were measured by a particle size distribution-measuring device: MULTISIZER III (trade name) manufactured by Beckman Coulter, Inc. under the conditions that an aperture diameter was 20 μm and the number of particles for measurement was 50,000 counts. On the basis of the measurement result thus obtained, volume particle size distribution and number particle size distribution of the sample particles were determined. On the basis of the volume particle size distribution thus determined, a volume average particle size ($D_{50v}$) and a content (% by volume) of the coarse toner particles based on the entire toner particles were determined. And also on the basis of the number particle size distribution thus determined, a content (% by number) of the fine toner particles based on the entire toner particles was determined.

[Average Degree of Circularity]

In 10 ml of water having about 0.1 g of surfactant dissolved therein, 5 mg of a toner was dispersed, thereby preparing dispersion which was then irradiated for five minutes with ultrasonic waves having 20 kHz frequencies and 50 W outputs so that concentration of toner particles in the dispersion was 5,000 pieces/μL to 20,000 pieces/μL. The above-stated flow particle image analyzer: FPIA-3000 manufactured by Sysmex Corporation was then used to determine a degree of circularity based on the above expression (1). Subsequently, from the measurement result of the degree of circularity, an average degree of circularity was determined in the simple calculation method.

Example 1

<Manufacture of Toner>

[Preliminarily Mixing Step and Melt-kneading Step]

Toner raw materials were mixed for 10 minutes by a Henschel mixer: FMMIXER (trade name) manufactured by Mitsui Mining Co., Ltd. The toner row materials contained 83% by weight (100 parts by weight) of polyester which serves as binder resin: Tafton TTR-5 (trade name) manufactured by Kao Corporation, having a glass transition temperature (Tg) of 60° C. and a softening temperature (Tm) of 100° C.; 12% by weight (14.5 parts by weight) of master batch containing 40% by weight of C.I. pigment red 57:1 which serves as colorant; 3% by weight (3.6 parts by weight) of carnauba wax which serves as a release agent: REFINED CARNAUBA WAX (trade name) manufactured by S. KATO & CO., having a melting temperature of 83° C.; and 2% by weight (2.4 parts by weight) of alkyl salicylate metal salt which serves as a charge control agent: BONTRON E-84 (trade name) manufactured by Orient Chemical Industries, Ltd. And a mixture thus obtained was melt-kneaded by a twin screw extruder: PCM-65 (trade name) manufactured by Ikegai Co. A melt-kneaded product was thus prepared.

[Pulverizing Step]

The melt-kneaded product obtained through the preliminarily mixing step and the melt-kneading step was cooled down to room temperature and thus solidified, thereafter being coarsely solidified by means of a cutting mill: VM-16 (trade name) manufactured by Kabushiki Kaisha Orient. Next, a coarsely pulverized product obtained by the above coarse pulverization was finely pulverized by means of a fluidized-bed jet pulverizer: COUNTER JET MILL (trade name) manufactured by Hosokawa Micron Corporation. A pulverized product was thus prepared.

[Classifying Step]

The pulverized product obtained in the pulverizing step was classified by means of a rotary pneumatic classifier manufactured by Hosokawa Micron Corporation, into excessively pulverized toner particles having a volume average particle size of 3.0 μm or less, a large-sized toner particle group of particles having a volume average particle size of 7.60 μm, and a small-sized toner particle group of particles having a volume average particle size of 5.54 μm. The excessively pulverized toner particles were collected for reuse in manufacturing other toners.

[Mixing Step]

The large-sized toner particle group of particles and small-sized toner particle group of particles obtained in the classifying step were mixed in a mixing ratio of 6 to 10 by means of a Henschel mixer: FMMIXER (trade name) manufactured by Mitsui Mining Co., Ltd.). A toner of Example 1 was thus manufactured.

In the toner of Example 1, a volume average particle size of the entire toner particles was 5.90 μm; a content of the coarse toner particles was 26% by volume based on the entire toner particles, a content of the fine toner particles was 29% by number based on the entire toner particles; and an average degree of circularity was 0.956.

Example 2

A toner of Example 2 was manufactured in the same manner as in Example 1, except that the pulverized product was classified into a large-sized toner particle group of particles having a volume average particle size of 7.62 μm, and a small-sized toner particle group of particles having a volume average particle size of 5.56 μm in the classifying step; the small-sized toner particle group of particles was treated with the spheronization process by means of a hot-air-type spheronizing device: METEORRAINBOW (trade name) manufactured by Nippon Pneumatic MFG. Co., Ltd before the mixing step; and the large-sized toner particle group of particles and small-sized toner particle group of particles were mixed in a mixing ratio of 26 to 10 in the mixing step.

Conditions for the spheronization process were set as follows: input of the excessively pulverized toner particles 3.0 kg/h, a supply of the hot air 900 L/m, a hot air temperature 190° C., supply pressure of cooling air 0.15 MPa, and a supply of air from the secondary air jet nozzle 230 L/m. In addition, a distance between an inlet of cooling air and an impact member was set at 2.0 cm.

In the toner of Example 2, a volume average particle size of the entire toner particles was 6.80 μm; a content of the coarse toner particles was 40% by volume based on the entire toner particles; a content of the fine toner particles was 28% by number based on the entire toner particles; and an average degree of circularity was 0.957.

Example 3

A toner of Example 3 was manufactured in the same manner as in Example 1, except that the pulverized product was classified into a large-sized toner particle group of particles having a volume average particle size of 7.61 μm, and a small-sized toner particle group of particles having a volume average particle size of 5.53 μm in the classifying step; the small-sized toner particle group of particles was treated with the spheronization process by means of an impact-type spheronizing device: FACULTY F-600 (trade name) manufactured by Hosokawa Micron Corporation before the mixing step; and the large-sized toner particle group of particles and small-sized toner particle group of particles were mixed in a mixing ratio of 7 to 10 in the mixing step.

As to conditions for the spheronization process, one input of the excessively pulverized toner particles was set at 1.5 kg, and the spheronization process was carried out for 120 seconds with a dispersion rotor rotating at speed of 5,800 rpm while the fine particles were removed by means of the classification rotor rotating at speed of 5,000 rpm. The processing time for spheronization indicates a length of time which starts with completion of input of the excessively pulverized toner particles and ends with opening of the second toner particle discharge valve. In addition, a distance between the dispersion rotor and the liner was set at 2.0 mm, and a distance between an end of a partition member and an inner wall surface of a treatment tank was set at 40 mm.

In the toner of Example 3, a volume average particle size of the entire toner particles was 6.00 μm; a content of the coarse toner particles was 30% by volume based on the entire toner particles; a content of the fine toner particles was 16% by number based on the entire toner particles; and an average degree of circularity was 0.968.

Example 4

A toner of Example 4 was manufactured in the same manner as in Example 1, except that the pulverized product was classified into a large-sized toner particle group of particles having a volume average particle size of 8.50 μm, and a small-sized toner particle group of particles having a volume average particle size of 5.50 μm in the classifying step; and the large-sized toner particle group of particles and small-sized toner particle group of particles were mixed in a mixing ratio of 25 to 10 in the mixing step.

In the toner of Example 4, a volume average particle size of the entire toner particles was 7.60 μm; a content of the coarse toner particles was 42% by volume based on the entire toner particles; a content of the fine toner particles was 11% by number based on the entire toner particles; and an average degree of circularity was 0.961.

Example 5

A toner of Example 5 was manufactured in the same manner as in Example 1, except that the pulverized product was classified into a large-sized toner particle group of particles having a volume average particle size of 6.80 μm, and a small-sized toner particle group of particles having a volume average particle size of 4.70 μm in the classifying step; and the large-sized toner particle group of particles and small-sized toner particle group of particles were mixed in a mixing ratio of 5 to 10 in the mixing step.

In the toner of Example 5, a volume average particle size of the entire toner particles was 5.30 μm; a content of the coarse toner particles was 24% by volume based on the entire toner particles; a content of the fine toner particles was 48% by number based on the entire toner particles; and an average degree of circularity was 0.961.

Example 6

A toner of Example 6 was manufactured in the same manner as in Example 1, except that the pulverized product was classified into a large-sized toner particle group of particles having a volume average particle size of 7.40 μm, and a small-sized toner particle group of particles having a volume average particle size of 5.37 μm in the classifying step; and the large-sized toner particle group of particles and small-sized toner particle group of particles were mixed in a mixing ratio of 4 to 10 in the mixing step.

In the toner of Example 6, a volume average particle size of the entire toner particles was 5.89 μm; a content of the coarse toner particles was 27% by volume based on the entire toner particles; a content of the fine toner particles was 28% by number based on the entire toner particles; and an average degree of circularity was 0.954.

Example 7

A toner of Example 7 was manufactured in the same manner as in Example 1, except that the pulverized product was classified into a large-sized toner particle group of particles having a volume average particle size of 7.50 μm, and a small-sized toner particle group of particles having a volume average particle size of 5.68 μm in the classifying step; the small-sized toner particle group of particles was treated with the spheronization process by means of the hot-air-type spheronizing device: METEORAINBOW (trade name) manufactured by Nippon Pneumatic MFG. Co., Ltd before the mixing step; and the large-sized toner particle group of particles and small-sized toner particle group of particles were mixed in a mixing ratio of 7 to 10 in the mixing step. The conditions for the spheronization process were the same as those in Example 2.

In the toner of Example 7, a volume average particle size of the entire toner particles was 6.03 μm; a content of the coarse toner particles was 28% by volume based on the entire toner particles; a content of the fine toner particles was 28% by number based on the entire toner particles; and an average degree of circularity was 0.976.

Comparative Example 1

A toner of Comparative example 1 was manufactured in the same manner as in Example 1, except that the pulverized product was classified into a large-sized toner particle group of particles having a volume average particle size of 9.20 μm, and a small-sized toner particle group of particles having a volume average particle size of 6.10 μm in the classifying step; and the large-sized toner particle group of particles and small-sized toner particle group of particles were mixed in a mixing ratio of 8 to 10 in the mixing step.

In the toner of Comparative example 1, a volume average particle size of the entire toner particles was 8.03 μm; a content of the coarse toner particles was 46% by volume based on the entire toner particles; a content of the fine toner particles was 28% by number based on the entire toner particles; and an average degree of circularity was 0.957.

Comparative Example 2

A toner of Comparative example 2 was manufactured in the same manner as in Example 1, except that the pulverized product was classified into a large-sized toner particle group of particles having a volume average particle size of 4.80 μm, and a small-sized toner particle group of particles having a volume average particle size of 3.40 μm in the classifying step; and the large-sized toner particle group of particles and small-sized toner particle group of particles were mixed in a mixing ratio of 8 to 10 in the mixing step.

In the toner of Comparative example 2, a volume average particle size of the entire toner particles was 3.98 μm; a content of the coarse toner particles was 10% by volume based on the entire toner particles; a content of the fine toner particles was 63% by number based on the entire toner particles; and an average degree of circularity was 0.956.

Comparative Example 3

A toner of Comparative example 3 was manufactured in the same manner as in Example 1, except that the pulverized product was classified into a large-sized toner particle group of particles having a volume average particle size of 7.58 μm, and a small-sized toner particle group of particles having a volume average particle size of 5.39 μm in the classifying step; and the large-sized toner particle group of particles and small-sized toner particle group of particles were mixed in a mixing ratio of 6 to 10 in the mixing step.

In the toner of Comparative example 3, a volume average particle size of the entire toner particles was 6.10 μm; a content of the coarse toner particles was 19% by volume based on the entire toner particles; a content of the fine toner particles was 36% by number based on the entire toner particles; and an average degree of circularity was 0.955.

Comparative Example 4

A toner of Comparative example 4 was manufactured in the same manner as in Example 1, except that the pulverized product was classified into a large-sized toner particle group of particles having a volume average particle size of 9.90 μm, and a small-sized toner particle group of particles having a volume average particle size of 4.80 μm in the classifying step; the small-sized toner particle group of particles was treated with the spheronization process by means of the impact-type spheronizing device. FACULTY F-600 (trade name) manufactured by Hosokawa Micron Corporation before the mixing step; and the large-sized toner particle group of particles and small-sized toner particle group of particles were mixed in a mixing ratio of 20 to 10 in the mixing step. The conditions for the spheronization process were the same as those in Example 3.

In the toner of Comparative example 4, a volume average particle size of the entire toner particles was 7.98 μm; a content of the coarse toner particles was 48% by volume based on the entire toner particles; a content of the fine toner particles was 20% by number based on the entire toner particles; and an average degree of circularity was 0.969.

Comparative Example 5

A toner of Comparative example 5 was manufactured in the same manner as in Example 1, except that the pulverized product was classified into a large-sized toner particle group of particles having a volume average particle size of 7.61 μm, and a small-sized toner particle group of particles having a volume average particle size of 5.80 μm in the classifying step; and the large-sized toner particle group of particles and small-sized toner particle group of particles were mixed in a mixing ratio of 2 to 10 in the mixing step.

In the toner of Comparative example 5, a volume average particle size of the entire toner particles was 5.82 μm; a content of the coarse toner particles was 24% by volume based on the entire toner particles; a content of the fine toner particles was 51% by number based on the entire toner particles; and an average degree of circularity was 0.957.

Comparative Example 6

A toner of Comparative example 6 was manufactured in the same manner as in Example 1, except that the pulverized product was classified into a large-sized toner particle group of particles having a volume average particle size of 8.80 μM, and a small-sized toner particle group of particles having a volume average particle size of 5.67 μm in the classifying step; and the large-sized toner particle group of particles and small-sized toner particle group of particles were mixed in a mixing ratio of 22 to 10 in the mixing step.

In the toner of Comparative example 6, a volume average particle size of the entire toner particles was 7.60 μm; a content of the coarse toner particles was 40% by volume based on the entire toner particles; a content of the fine toner particles was 9% by number based on the entire toner particles; and an average degree of circularity was 0.955.

Comparative Example 7

A toner of Comparative example 7 was manufactured in the same manner as in Example 1, except that the pulverized product was classified into a large-sized toner particle group of particles having a volume average particle size of 7.35 μm, and a small-sized toner particle group of particles having a volume average particle size of 5.64 μm in the classifying step; and the large-sized toner particle group of particles and small-sized toner particle group of particles were mixed in a mixing ratio of 5 to 10 in the mixing step.

In the toner of Comparative example 7, a volume average particle size of the entire toner particles was 5.90 μm; a content of the coarse toner particles was 22% by volume based on the entire toner particles; a content of the fine toner particles was 29% by number based on the entire toner particles; and an average degree of circularity was 0.955.

Comparative Example 8

A toner of Comparative example 8 was manufactured in the same manner as in Example 1, except that the pulverized product was classified into a large-sized toner particle group of particles having a volume average particle size of 9.06 μm, and a small-sized toner particle group of particles having a volume average particle size of 6.10 μm in the classifying step; and the large-sized toner particle group of particles and small-sized toner particle group of particles were mixed in a mixing ratio of 18 to 10 in the mixing step.

In the toner of Comparative example 8, a volume average particle size of the entire toner particles was 8.02 μm; a content of the coarse toner particles was 46% by volume based on the entire toner particles; a content of the fine toner particles was 9% by number based on the entire toner particles; and an average degree of circularity was 0.958.

Comparative Example 9

A toner of Comparative example 9 was manufactured in the same manner as in Example 1, except that the pulverized product was classified into a large-sized toner particle group of particles having a volume average particle size of 9.01 μm, and a small-sized toner particle group of particles having a volume average particle size of 6.10 μm in the classifying step; and the large-sized toner particle group of particles and small-sized toner particle group of particles were mixed in a mixing ratio of 16 to 10 in the mixing step.

In the toner of Comparative example 9; a volume average particle size of the entire toner particles was 8.06 μm; a content of the coarse toner particles was 49% by volume based on the entire toner particles; a content of the fine toner particles was 12% by number based on the entire toner particles; and an average degree of circularity was 0.958.

Comparative Example 10

A toner of Comparative example 10 was manufactured in the same manner as in Example 1, except that the pulverized product was classified into a large-sized toner particle group of particles having a volume average particle size of 9.20 μm, and a small-sized toner particle group of particles having a volume average particle size of 6.10 μm in the classifying step; and the large-sized toner particle group of particles and small-sized toner particle group of particles were mixed in a mixing ratio of 17 to 10 in the mixing step.

In the toner of Comparative example 10, a volume average particle size of the entire toner particles was 8.10 μm; a content of the coarse toner particles was 40% by volume based on the entire toner particles; a content of the fine toner particles was 20% by number based on the entire toner particles; and an average degree of circularity was 0.954.

Comparative Example 11

A toner of Comparative example 11 was manufactured in the same manner as in Example 1, except that the pulverized product was classified into a large-sized toner particle group of particles having a volume average particle size of 9.01 μm, and a small-sized toner particle group of particles having a volume average particle size of 6.02 μm in the classifying step; and the large-sized toner particle group of particles and small-sized toner particle group of particles were mixed in a mixing ratio of 16 to 10 in the mixing step.

In the toner of Comparative example 11, a volume average particle size of the entire toner particles was 8.10 μm; a content of the coarse toner particles was 48% by volume based on the entire toner particles; a content of the fine toner particles was 9% by number based on the entire toner particles; and an average degree of circularity was 0.954.

Hereinbelow, Table 1 collectively shows, for each of Examples 1 to 7 and Comparative examples 1 to 11, a volume average particle size $D_{50v}$ of the large-sized toner particle group of particles, a volume average particle size $D_{50v}$ of the small-sized toner particle group of particles, a volume average particle size $D_{50v}$ of the entire toner particles, a mixing ratio of the large-sized toner particle group of particles (which may be referred to "large" in Table 1) to the small-sized toner particle group of particles (which may be referred to "small" in Table 1), a content of the coarse toner particles based on the entire toner particles, a content of the fine toner particles based on the entire toner particles, and an average degree of circularity of the toner particles.

TABLE 1

| | Large-sized toner particle group $D_{50v}$ (μm) | Small-sized toner particle group $D_{50v}$ (μm) | Toner | | | | |
|---|---|---|---|---|---|---|---|
| | | | Mixing ratio (large:small) | $D_{50v}$ (μm) | Content of coarse toner particles (% by volume) | Content of fine toner particles (% by number) | Average degree of circularity |
| Ex. 1 | 7.60 | 5.54 | 6:10 | 5.90 | 26 | 29 | 0.956 |
| Ex. 2 | 7.62 | 5.56 | 26:10 | 6.80 | 40 | 28 | 0.957 |
| Ex. 3 | 7.61 | 5.53 | 7:10 | 6.00 | 30 | 16 | 0.968 |
| Ex. 4 | 8.50 | 5.50 | 25:10 | 7.60 | 42 | 11 | 0.961 |
| Ex. 5 | 6.80 | 4.70 | 5:10 | 5.30 | 24 | 48 | 0.961 |
| Ex. 6 | 7.40 | 5.37 | 4:10 | 5.89 | 27 | 28 | 0.954 |
| Ex. 7 | 7.50 | 5.68 | 7:10 | 6.03 | 28 | 28 | 0.976 |
| Comp. ex. 1 | 9.20 | 6.10 | 8:10 | 8.03 | 46 | 28 | 0.957 |
| Comp. ex. 2 | 4.80 | 3.40 | 8:10 | 3.98 | 10 | 63 | 0.956 |
| Comp. ex. 3 | 7.58 | 5.39 | 6:10 | 6.10 | 19 | 36 | 0.955 |
| Comp. ex. 4 | 8.90 | 4.80 | 20:10 | 7.98 | 48 | 20 | 0.969 |
| Comp. ex. 5 | 7.61 | 5.80 | 2:10 | 5.82 | 24 | 51 | 0.957 |
| Comp. ex. 6 | 8.80 | 5.67 | 22:10 | 7.60 | 40 | 9 | 0.955 |
| Comp. ex. 7 | 7.35 | 5.64 | 5:10 | 5.90 | 22 | 29 | 0.955 |
| Comp. ex. 8 | 9.06 | 6.10 | 18:10 | 8.02 | 46 | 9 | 0.958 |
| Comp. ex. 9 | 9.01 | 6.10 | 16:10 | 8.06 | 49 | 12 | 0.958 |
| Comp. ex. 10 | 9.20 | 6.10 | 17:10 | 8.10 | 40 | 20 | 0.954 |
| Comp. ex. 11 | 9.01 | 6.02 | 16:10 | 8.10 | 48 | 9 | 0.954 |

[Manufacture of Two-component Developer]

A ferrite core carrier having a volume average particle size of 45 μm was used as a carrier. A toner and the carrier were mixed for 20 minutes by means of a V-type mixer; V-5 (trade name) manufactured by Tokuju Corporation so as to be 60% in coverage of each toner of Examples 1 to 7 and Comparative examples 1 to 11 over the carrier.

[Evaluation]

By using methods described below, evaluations were made on void and resolution of images formed by using the two-component developers respectively containing the toners of Examples 1-7 and Comparative examples 1-1, as well as transfer efficiency, cleaning property and charge stability in forming the images. The results thus obtained and comprehensive evaluations are shown in Table 2.

[Void]

A commercially-available copier: MX-2300G (trade name) manufactured by Sharp Corporation was filled with the two-component developers respectively containing the toners of Examples 1-7 and Comparative examples 1-11, and an attachment amount was adjusted to be 0.4 mg/cm$^2$, so as to form a 3×5-isolated-dot image. The 3×5-isolated-dot image refers to an image so formed that at 600 dpi (dot per inch), adjacent dot parts among plural dot parts each having a length of three dots and a width of three dots are separated from each other by a distance of five dots. The formed image was enlarged by 100-fold using a microscope manufactured by Keyence Corporation and displayed on a monitor. Out of 70 pieces of 3×5 isolated-dot portions, the number of void-occurring portions was determined. Note that evaluations "Excellent", "Good", "Not bad", and "Poor" are used to show results of evaluation on the void. Evaluation criteria are as follows.

Excellent: The number of the void-occurring portions remains in a range of from zero to 3.

Good: The number of the void-occurring portions remains in a range of from 4 to 6.

Not bad: The number of the void-occurring portions remains in a range of from 7 to 10.

Poor: The number of the void-occurring portions is 11 or more.

[Resolution]

A document having an original image drawn in exact-100 μm-wide thin lines was copied by the above copier under a condition that a 5 mm-diameter halftone image having image density of 0.3 can be copied so as to have the image density remaining in 0.3 or higher and 0.5 or lower. The copy image thus obtained was used as a sample for measurement. A width of thin line formed in the sample for measurement was determined by an indicator, on the basis of a monitor image which was obtained by enlarging by 100-fold the sample for measurement using a particle analyzer: LUZEX450 (trade name) manufactured by Nireco Corporation). The image density refers to optical reflection density measured by a reflection densitometer; RD-918 (trade name) manufactured by Macbeth Corporation. The thin line has irregularities and a width of the thin line thus changes depending on measurement positions. Therefore an average value of line widths measured at plural measurement positions was calculated and determined to be a line width of the sample for measurement. A reproducibility value of the thin line was obtained by centupling a value which was calculated by dividing the line width of the sample for measurement by the line width 100 μm of the document. When the reproducibility value of the thin line is closer to 100, the reproducibility of the thin line is better and the resolution is higher. Note that evaluations "Excellent", "Good", "Not bad", and "Poor" are used to show results of evaluation on the resolution. Evaluation criteria are as follows.

Excellent: The reproducibility value of the thin line is 100 or more and less than 105.

Good: The reproducibility value of the thin line is 105 or more and less than 115.

Not bad: The reproducibility value of the thin line is 115 or more and less than 125.

Poor: The reproducibility value of the thin line is 125 or more.

[Transfer Efficiency]

Transfer efficiency refers to a proportion of the toner transferred from the surface of the photoreceptor drum to the intermediate transfer belt in one primary transfer. The transfer efficiency was calculated by assuming an amount of toner existent on the photoreceptor drum prior to the transfer to be 100%. The amount of the toner existent on the photoreceptor drum prior to the transfer was determined by measuring an amount of the toner suctioned by a charge quantity measuring device: 210HS-2A (trade name) manufactured by Trek Japan K.K. In addition, an amount of the toner transferred onto the intermediate transfer belt was also determined in the same manner. Note that evaluations "Excellent", "Good", "Not bad", and "Poor" are used to show results of evaluation on the transfer efficiency. Evaluation criteria are as follows.

Excellent: The transfer efficiency is 95% or more.

Good: The transfer efficiency is 90% or more and less than 95%.

Not bad: The transfer efficiency is 85% or more and less than 90%.

Poor: The transfer efficiency is less than 85%.

[Cleaning Property]

A pressure of a cleaning blade was adjusted so that an initial linear pressure attained to 25 gf/cm ($2.45\times10^{-1}$ N/cm), wherein the pressure of the cleaning blade refers to a pressure occurring when the cleaning blade of a cleaning unit disposed in the commercially-available copier: MX-2300G (trade name) manufactured by Sharp Corporation makes contact with the photoreceptor drum. This copier was filled with the two-component developers respectively containing the toners of Examples 1-7 and Comparative examples 1-11. By using such a copier as just described, 100,000 copies of a character text chart created by Sharp Corporation were made at 25° C. and at 50% relative humidity, so as to determine the cleaning property.

By checking a formed image with eyes in three stages: before the image formed (an initial stage); after 5,000 (5K) copies were made; and after 10,000 (10K) copies were made, a test was conducted on definition of a boundary located between an image area and a non-image area, as well as on existence or nonexistence of a black streak formed of a toner leaking in a rotation direction of the photoreceptor drum. Further, an amount of fog Wk of the formed image was determined by a later-described measuring device. The cleaning property was thus evaluated. Reflection density was measured by using a color measuring system z-Σ90 manufactured by Nippon Denshoku Industries Co., Ltd. and the amount of fog Wk of the formed image was determined as follows. First of all, reflection average density Wr of recording paper was measured prior to image formation. Next, an image was formed by the above copier, and reflection density was then measured at different white parts of the recording paper. A value obtained according to the following expression (3) was defined as the amount of fog Wk (%), wherein Ws represents reflection density of a part greatest in fog amount, namely a white part highest in density, and Wr represents the reflection average density described above. Note that evaluations "Excellent", "Good", "Not bad", and "Poor" are used to show results of evaluation on the cleaning property, Evaluation criteria are as follows.

$$Wk(\%)=100\times((Ws-Wr)/Wr) \quad (3)$$

Excellent: Very favorable. The definition is good and no black streak appears. And the amount of fog Wk is less than 3%.

Good: Favorable. The definition is good and no black streak appears. And the amount of fog Wk is 3% or more and less than 5%.

Not bad: No problem in practical use. The definition basically does not induce a problem in practical use and the break streaks is 2.0 mm or less in length and 5 pieces or less in number. And the amount of fog Wk is 5% or more and less than 10%.

Poor: Unusable in practice. There exists a problem in definition in practical use. The black streaks are at least either greater than 2.0 μm in length or 6 pieces or more in number. And the amount of fog Wk is 10% or more.

[Charge Stability]

With 5% by weight of the respective toners of Examples 1-7 and Comparative examples 1-11, 95% by weight of ferrite carrier having a volume average particle size of 45 μm was respectively mixed and stirred for 30 minutes in a normal temperature and normal humidity environment at 25° C. and 50% relative humidity by using a desk ball mill manufactured by Tokyo Glass Kikai Kabushiki Kaisha. And then, charge amounts of the toners in the initial stage were measured. Further, using the two-component developers respectively containing the toners of Examples 1-7 and Comparative examples 1-11, a text chart having a print ratio of 6% was copied to make 10,000 copies by a commercially-available copier: AR-C150 (trade name) manufactured by Sharp Corporation. And then, charge amounts of the toners were measured again.

The charge amounts of the toners were measured as described below by using a charge amount measuring device: 210HS-2A (trade name) manufactured by Trek Japan K.K. A mixture of ferrite particles and toner collected from the ball mill was put into a metal container having a 500-mesh electrically-conductive screen at its bottom. Only the toner was thereafter suctioned by a suction machine at a suction pressure of 250 mmHg. And then, the charge amount of the toner was calculated on the basis of a weight difference between the before-suction mixture and the after-suction mixture and a potential difference between electrode plates of a capacitor connected to the container. A decrease rate in charge amount of the toner was determined according to the following expression (4), wherein $Q_{ini}$ (μC/g) represents the initial charge amount of toner calculated as above, and Q (μC/g) represents the charge amount of toner measured as above after 10,000 (10K) copies had been made.

$$\text{Decrease rate in charge amount}(\%)=100\times|(Q-Q_{ini})/Q_{ini}| \quad (4)$$

The lower the decrease rate in the charge amount is, the better the charge stability is. Note that evaluations "Excellent", "Good", "Not bad", and "Poor" are used to show results of evaluation on the charge stability. Evaluation criteria are as follows.

Excellent: The decrease rate in the charge amount is less than 5%.

Good: The decrease rate in the charge amount is 5% or more and less than 10%.

Not bad: The decrease rate in the charge amount is 10% or more and less than 15%.

Poor: The decrease rate in the charge amount is 15% or more.

[Comprehensive Evaluation]

Note that evaluations "Excellent", "Good", "Not bad", and "Poor" are used to show results of the comprehensive evaluation. Evaluation criteria are as follows.

Excellent: Very favorable. No "Poor" is given and one or less "Not bad" is given in the results of evaluation on void, resolution, transfer efficiency, cleaning property, and charge stability.

Good: Favorable. No "Poor" is given and two or more and three or less "Not bad" are given in the results of evaluation on void, resolution, transfer efficiency, cleaning property, and charge stability.

Not bad: No problem in practical use. No "Poor" is given and four or more "Not bad" are given in the results of evaluation on void, resolution, transfer efficiency, cleaning property, and charge stability.

Poor: Unusable in practice. At least one "Poor" is given in the results of evaluation on void, resolution, transfer efficiency, cleaning property, and charge stability.

opers containing the toners of Comparative examples 1-11, the two-component developers containing the toners of Examples 1-7 exhibited better evaluation results on void, resolution, transfer efficiency, cleaning property, and charge stability.

Further, in each of the toners of Examples 1-5, the average degree of circularity of the entire toner particles was 0.955 or more and 0.975 or less. As compared with the two-component developers containing the toners of Examples 6 and 7, the two-component developers containing the toners of Examples 1-5 exhibited still better evaluation results on void, resolution, transfer efficiency, cleaning property, and charge stability.

The two-component developer containing the toner of Comparative example 1 exhibited degraded resolution since the volume average particle size $D_{50v}$ of the entire toner particles was more than 8 μm.

The two-component developer containing the toner of Comparative example 2 exhibited degraded transfer efficiency, cleaning property, and charge stability since the volume average particle size $D_{50v}$ of the entire toner particles was less than 4 μm, the content of the coarse toner particles based on the entire toner particles was less than 24% by volume, and the content of the fine toner particles based on the entire toner particles was more than 50% by number.

TABLE 2

| | Image evaluation | | Transfer efficiency | | Cleaning property | | | Charge stability | | | | |
|---|---|---|---|---|---|---|---|---|---|---|---|---|
| | Void | Resolution | Measurement value (%) | Evaluation | Initial | After 5K copies | After 10K copies | Initial (μC/g) | After 10K copies (μC/g) | Decrease rate (%) | Evaluation | Comprehensive evaluation |
| Ex. 1 | Good | Good | 91 | Good | Excellent | Excellent | Excellent | −19.2 | −18.0 | 6.3 | Good | Excellent |
| Ex. 2 | Excellent | Excellent | 98 | Excellent | Excellent | Good | Good | −19.2 | −18.6 | 3.1 | Excellent | Excellent |
| Ex. 3 | Excellent | Excellent | 98 | Excellent | Excellent | Excellent | Excellent | −18.7 | −17.9 | 4.3 | Excellent | Excellent |
| Ex. 4 | Good | Good | 96 | Excellent | Excellent | Good | Good | −19.2 | −18.4 | 4.2 | Excellent | Excellent |
| Ex. 5 | Good | Excellent | 96 | Excellent | Excellent | Good | Not bad | −18.9 | −17.8 | 5.8 | Good | Excellent |
| Ex. 6 | Not bad | Good | 89 | Not bad | Excellent | Excellent | Excellent | −17.6 | −16.1 | 8.5 | Good | Good |
| Ex. 7 | Excellent | Good | 97 | Excellent | Excellent | Not bad | Not bad | −18.5 | −17.8 | 3.8 | Excellent | Good |
| Comp. ex. 1 | Good | Poor | 98 | Excellent | Excellent | Good | Good | −18.9 | −17.0 | 10.1 | Not bad | Poor |
| Comp. ex. 2 | Good | Excellent | 83 | Poor | Not bad | Not bad | Poor | −18.8 | −15.9 | 15.4 | Poor | Poor |
| Comp. ex. 3 | Good | Good | 83 | Poor | Excellent | Good | Good | −18.9 | −17.0 | 10.1 | Not bad | Poor |
| Comp. ex. 4 | Good | Poor | 98 | Excellent | Excellent | Good | Not bad | −19.1 | −15.9 | 16.8 | Poor | Poor |
| Comp. ex. 5 | Good | Good | 80 | Poor | Not bad | Not bad | Not bad | −18.2 | −16.5 | 9.3 | Good | Poor |
| Comp. ex. 6 | Excellent | Poor | 85 | Not bad | Excellent | Good | Good | −18.9 | −16.9 | 10.6 | Not bad | Poor |
| Comp. ex. 7 | Not bad | Good | 78 | Poor | Excellent | Good | Good | −19.2 | −17.0 | 11.5 | Not bad | Poor |
| Comp. ex. 8 | Good | Poor | 92 | Good | Excellent | Good | Good | −19.8 | −17.9 | 9.6 | Good | Poor |
| Comp. ex. 9 | Good | Poor | 93 | Good | Excellent | Good | Good | −19.2 | −17.0 | 11.5 | Not bad | Poor |
| Comp. ex. 10 | Not bad | Poor | 86 | Not bad | Excellent | Excellent | Excellent | −21.8 | −18.3 | 16.1 | Poor | Poor |
| Comp. ex. 11 | Not bad | Poor | 81 | Poor | Not bad | Poor | Poor | −22.1 | −18.1 | 18.1 | Poor | Poor |

As described below, the results shown in Table 2 make it clear that the two-component developers containing the toners of Examples 1-7 are superior to the two-component developers containing the toners of Comparative examples 1-11.

In each of the two-component developers containing the toners of Examples 1-7, the volume average particle size $D_{50v}$ of the entire toner particles was 4 μm or more and 8 μm or less; the volume average particle size $D_{50v}$ of the coarse toner particles was 24% by volume or more and 47% by volume or less; and the volume average particle size $D_{50v}$ of the fine toner particles was 10% by number or more and 50% by number or less. As compared with the two-component developers containing the toners of Comparative examples 3 and 7 exhibited degraded transfer efficiency since each content of the coarse toner particles based on the entire toner particles was less than 24% by volume.

The two-component developer containing the toner of Comparative example 4 exhibited degraded resolution and charge stability since the content of the coarse toner particles based on the entire toner particles was more than 47% by volume.

The two-component developer containing the toner of Comparative example 5 exhibited degraded transfer efficiency since the content of the fine toner particles based on the entire toner particles was more than 50% by number.

The two-component developer containing the toner of Comparative example 6 exhibited degraded resolution since the content of the fine toner particles based on the entire toner particles was less than 10% by number.

The two-component developers containing the toners of Comparative examples 8-11 exhibited degraded resolution since each volume average particle size $D_{50v}$ of the entire toner particles was more than 8 μm, each content of the coarse toner particles based on the entire toner particles was high, and each content of the fine toner particles based on the entire toner particles was low.

Note that although a magenta toner containing C.I. pigment red 57:1 as colorant was used as an example of the electrophotographic toner in the present Examples, a usable toner is not limited to the above magenta toner, and any other toners containing colorants cited above may replace such colorant to carry out Examples in the same manners.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing a toner comprising:

a preliminarily mixing step of mixing at least binder resin and colorant into a mixture;

a melt-kneading step of melt-kneading the mixture into a melt-kneaded product;

a pulverizing step of pulverizing the melt-kneaded product into a pulverized product;

a classifying step of classifying the pulverized product into a large-sized toner particle group of particles and a small-sized toner particle group of particles having a volume average particle size smaller than that of the large-sized toner particle group of particles;

a spheronizing step of treating the small-sized toner particle group of particles with a spheronization process;

a mixing step of mixing the large-sized toner particle group of particles not treated with a spheronization process and the small-sized toner particle group of particles treated with a spheronization process;

wherein the toner comprising toner particles containing at least binder resin and colorant, the toner particles including the large-sized toner particle group of particles and the small-sized toner particle group of particles having a volume average particle size smaller than that of the large-sized toner particle group of particles, wherein a volume average particle size $D_{50v}$ which is a particle size at 50% in accumulated volume counted from a large particle-side in accumulated volume distribution of entire toner particles is 4 μm or more and 8 μm or less, a content of toner particles contained in a toner particle group having a volume average particle size of 7 μm or more is 24% by volume or more and 47% by volume or less based on the entire toner particles, and a content of toner particles contained in a toner particle group having a number average particle size of 5 μm or less is 10% by number or more and 50% by number or less based on the entire toner particles.

2. The method of manufacturing a toner of claim 1, wherein a mixing ratio of the large-sized toner particle group of particles to the small-sized toner particle group of particles in the preliminarily mixing step is from 3.4:10 to 30:10.

3. The method of manufacturing a toner of claim 1, wherein mechanical impact or hot air is used for the spheronization process in the spheronizing step.

4. The method of manufacturing a toner of claim 1, wherein the large-sized toner particle group of particles has a volume average particle size of 6 μm or more and 9 μm or less.

5. The method of manufacturing a toner of claim 1, wherein the small-sized toner particle group of particles has a volume average particle size of 3.5 μm or more and less than 6 μm.

* * * * *